US011220124B2

(12) United States Patent
Zindl et al.

(10) Patent No.: US 11,220,124 B2
(45) Date of Patent: Jan. 11, 2022

(54) SELF-INKING STAMP WITH REMOVABLE STAMP PAD IN CARRYING DEVICE HAVING HANDLES

(71) Applicant: Trodat GmbH, Wels (AT)

(72) Inventors: Peter Zindl, Marchtrenk (AT); Markus Zehetner, Leonding (AT); Volker Martin, Linz (AT)

(73) Assignee: Trodat GmbH

( * ) Notice: Subject to any disclaimer, the term of this patent is extended or adjusted under 35 U.S.C. 154(b) by 0 days.

(21) Appl. No.: 16/653,356

(22) Filed: Oct. 15, 2019

(65) Prior Publication Data

US 2020/0039266 A1 Feb. 6, 2020

Related U.S. Application Data

(62) Division of application No. 13/147,107, filed as application No. PCT/AT2010/000020 on Jan. 21, 2010, now abandoned.

(30) Foreign Application Priority Data

Jan. 30, 2009 (AT) ..... A 174/2009
Jan. 20, 2010 (AT) ..... A 70/2010

(51) Int. Cl.
*B41K 1/36* (2006.01)
*B41K 1/54* (2006.01)
(Continued)

(52) U.S. Cl.
CPC ..... *B41K 1/02* (2013.01); *B41K 1/006* (2013.01); *B41K 1/36* (2013.01); *B41K 1/40* (2013.01); *B41K 1/42* (2013.01); *B41K 1/54* (2013.01)

(58) Field of Classification Search
CPC . B41K 1/02; B41K 1/006; B41K 1/36; B41K 1/38; B41K 1/40; B41K 1/42; B41K 1/54
(Continued)

(56) References Cited

U.S. PATENT DOCUMENTS 4,255,801 A 3/1981 Ode et al.
5,649,485 A * 7/1997 Dour ..... B41K 1/40 101/104

(Continued)

FOREIGN PATENT DOCUMENTS

AT 006732 U1 3/2004
AT 503827 A1 1/2008

(Continued)

OTHER PUBLICATIONS

International Search Report from Application No. PCT/AT2010/000020 dated Aug. 5, 2010, pp. 1-5.

(Continued)

*Primary Examiner* — Leslie J Evanisko
(74) *Attorney, Agent, or Firm* — Lerner, David, Littenberg, Krumholz & Mentlik, LLP

(57) ABSTRACT

The technology describes a stamp and stamp pad for a self-inking stamp, having a housing or a carrying device for a pad for absorbing ink. The carrying device is rectangular in shape, having a base plate with longitudinal surfaces and lateral surfaces moulded thereon. On two surfaces running in parallel handle elements for the lateral gripping of the carrying device are arranged. On the lateral surface a handle element for the lateral gripping and pulling of the carrying device out of a stamp are formed of a plurality of parts displaceable within one another. The handle elements are formed for insertion in a clearance of a lower part of the stamp and do not protrude out of the outer surface of the lower part, so that an upper part of the stamp is displaceable (Continued)

via the clearance with the handle elements inserted in the lower part.

9 Claims, 26 Drawing Sheets

(51) Int. Cl.
*B41K 1/02* (2006.01)
*B41K 1/00* (2006.01)
*B41K 1/42* (2006.01)
*B41K 1/40* (2006.01)

(58) Field of Classification Search
USPC ..... 101/103, 104, 109, 327, 333, 334
See application file for complete search history.

(56) References Cited

U.S. PATENT DOCUMENTS

| | | | | |
|---|---|---|---|---|
| 5,743,186 | A | 4/1998 | Liao | |
| 6,526,882 | B1 | 3/2003 | Shih | |
| 6,877,426 | B1 | 4/2005 | Huang | |
| 6,945,172 | B1 | 9/2005 | Shih | |
| 7,380,497 | B2 | 6/2008 | Faber | |
| 2004/0250719 | A1 | 12/2004 | Sculler | |
| 2005/0145127 | A1* | 7/2005 | Zindl ..... | B41K 1/40 101/333 |
| 2006/0144267 | A1 | 7/2006 | Moody | |
| 2006/0185539 | A1 | 8/2006 | Faber | |
| 2007/0272099 | A1 | 11/2007 | Pointl | |
| 2008/0148975 | A1 | 6/2008 | Faber | |
| 2011/0277647 | A1 | 11/2011 | Zindl et al. | |
| 2014/0196622 | A1* | 7/2014 | Shih ..... | B41K 1/40 101/333 |

FOREIGN PATENT DOCUMENTS

| | | | |
|---|---|---|---|
| DE | 202004010164 | U1 | 8/2004 |
| DE | 202006001417 | U1 | 4/2006 |
| EP | 0873245 | A1 | 10/1998 |
| EP | 1507666 | A1 | 2/2005 |
| EP | 2384283 | B1 | 4/2013 |
| EP | 2591919 | B1 | 12/2013 |
| EP | 2591920 | B1 | 2/2014 |
| EP | 2591921 | B1 | 2/2014 |
| JP | H066848 | U | 1/1994 |
| WO | 0183227 | A1 | 11/2001 |
| WO | 0183228 | A1 | 11/2001 |
| WO | 2003099572 | A1 | 12/2003 |
| WO | 2005084953 | A2 | 9/2005 |
| WO | 2010085828 | A2 | 8/2010 |

OTHER PUBLICATIONS

International Search Report for PCT/AT2019/060054 dated Jun. 26, 2019; 3 pages.

International Preliminary Report on Patentability for PCT/AI2019/060054 dated Apr. 9, 2020; 5 pages.

* cited by examiner

SELF-INKING STAMP WITH REMOVABLE STAMP PAD IN CARRYING DEVICE HAVING HANDLES

BACKGROUND OF THE INVENTION

The invention relates to a stamp pad, a stamp, and a transport clamp.

BRIEF SUMMARY OF THE INVENTION

Different stamps with replaceable stamp pads or replaceable carrying devices for stamp pads are already known. Such a so-called self-king stamp is described in WO 01/83 227 of the applicant. This self-inking stamp with upper inking comprises a lower part that can be placed on the surface to be stamped and a reversing mechanism—arranged therein—for a printing plate carrier that can be moved to and fro between an ink pad and a contact frame subject to simultaneous reversal. To this end, this printing plate carrier is movement-coupled with an actuation upper part, displaceable against the resetting force of a spring relative to the lower part, which surrounds the lower part, to the lateral parts of the actuation upper part through a reversing axle of the printing plate carrier guided in elongated holes of the lower part. The actuation upper pert also comprises a hinged hood part which in its closed position covers the ink pad shaft in the lower part. The ink pad shaft of the lower part of the stamp becomes accessible for replacing the ink pad by swiveling the hood part open.

Disadvantageous with the known stamps with replaceable ink or stamp pad in most cases is that for removing as well as re-inserting a stamp pad to be replaced a series of manipulations of the stamp or its parts is required, which gives many users the impression that the replacement operation is overly complicated.

From AT 503 827 B1 a stamp with a first housing part, with a second housing part that can be pivoted relative to the first housing part and with a stamp plate is known. The stamp plate can be swiveled about an axis located in a first end region of the first housing part from a rest position into a function position, wherein the stamp plate in the rest position is located between the first housing part and the second housing part. In the function position the first housing part, the second housing pad and stamp plate approximately form a triangle. The second housing part comprises a guide ink path which is in engagement with the stamp plate. On the stamp plate a control link path that is or can be brought into engagement with an actuation element is arranged. Furthermore, a stamp pad is arranged in the first housing part, wherein in the rest position the stamp plate contacts the stamp pad for picking up ink or through compression of the first and second housing part the stamp plate located in-between is pressed on to the stamp pad for picking up ink. To remove the stamp pad a depression is arranged on the first housing part on the top, so that actuation of the stamp pad is possible and it can be puled out of the housing part. Furthermore, means. more preferably engagement elements for fastening the stamp pad are arranged on the stamp pad so that falling out of the stamp pad is prevented.

Furthermore, a stamp with the designation "Mobile Printy" of the applicant is known from the prior art which approximately corresponds to the construction of AT 503 827 B1. With the "Mobile Printy", the removal of the stamp pad for example was improved. To this end, handle elements with engagement elements arranged thereon were provided on the stamp pad on the lateral surfaces. The handle elements are slid into clearances on the lateral surfaces of the first housing part provided for this purpose, wherein the engagement elements in the interior of the housing part engage in a protrusion. To avoid wrongly positioning the stamp pad in the first housing part the handle elements and the clearances were suitably shaped, wherein for this purpose a side of the handle element and correspondingly the clearance were designed half-round, so that the stamp pad can only be fully slid into the first housing part in one direction. In order to make it possible for the stamp pad to be removed, it is slightly compressed on the lateral handle elements as a result of which the engagement elements are moved towards each other and release the engagement so that the stamp pad can be removed from the first housing par through light pulling.

With such a construction the stamp pad is inserted longitudinally via the end face so that the handle elements are arranged on the longitudinal surfaces of the stamp pad. In order to achieve improved actuation of the engagement elements arranged on the handle elements, the handle elements laterally protrude over the lateral surfaces of the stamp, as a result of which the handle elements can be simply pressed together and thus the engagement in the interior of the stamp is released.

In addition, a transport clamp or a holder for manual stamps is known from EP 0 873 245 B1 with an outer housing, a stamp-carrying body which is fastened in the outer housing in a manner capable of sliding and which comprises a lower circumferential edge, and at least one spring which ejects the stamp-carrying body from the outer housing, wherein a cover having a receiving surface in order to strike against the lower circumferential edge of the stamp-carrying body, an elastic tongue, which is provided on the cover or on the outer housing, and a locking link which is provided on the outer housing or the cover, wherein the tongue and the locking link engage with each other when the stamp-carrying body is thrust back against the spring load force, and following the locking hold the stamp-carrying body in its retracted position.

Disadvantageous here is that with a holder of this type on the outer surface of the upper part a visual locking ink or tongue has to be arranged, which impairs the appearance of the stamp. At the same time, such a protrusion or edge also constitutes a corresponding risk of injury.

It is therefore the object of the invention to create a stamp with replaceable stamp pad, wherein the replacement of the stamp pad requires fewer handling steps by the user and the operating comfort for replacing a stamp pad s increased and the risk of contamination is greatly reduced. A further object of the invention lies in creating a stamp pad, wherein downward compatibility, that is use of the stamp pad in older stamps is ensured. Another object of the invention also lies in guaranteeing safe transport of the stamp.

The objects of the invention for a stamp pad are solved in that over at least a pert region of a lateral surface of the carrying device a surface running at an angle is arranged, on which the means for fixing in a stamp is positioned.

Here it is advantageous that as a result horizontal and vertical force effects are made possible, as a result of which the stamp pad is accurately held in position. More preferably through the additional action of the horizontal force it is achieved that in the rest position of the stamp, in which the printing plate presses against the stamp pad, the stamp pad can no longer yield horizontally, so that it is always ensured that the printing plate snugly bears on the stamp pad and is able to take up sufficient ink. Exact positioning of the stamp pad becomes ever more important through the use of multi-colour stamp pads, since through the necessary separation of the individual ink pads the position has to be maintained exactly, so that sufficient and correct ink reaches the printing plate. If such a stamp pad is displaced, it can happen that one or a plurality of letters or part regions of the letters come to bear on a separating wall arranged in the stamp pad and thus no ink can be taken up in this region of the printing plate. Through this positioning, deformation of the side walls of the pad holder will no longer occur.

Advantageous is a design wherein the means is formed through an indentation corresponding to a protrusion arranged in a stamp, since simpler and cost-effective fixing and positioning is created as a result.

With a further development, wherein the means is formed through at least one protrusion, cost-effective manufacture is again achieved.

However, it is also advantageous that the surface of angular orientation is formed at an angle of preferably 45° to a base plate of the carrying device, since as a result the optimal force distribution of the acting horizontal and vertical force for fixing and positioning is achieved.

Furthermore, the objects of the invention for a stamp pad are solved in that on the lateral surface of the carrying device a handle element each for the lateral secure holding and pulling out of the carrying device from a stamp formed of a plurality of parts displaceable within one another is arranged, wherein the handle elements are designed for insertion in a clearance of a lower part of the stamp and said handle elements do not protrude over the outer surface of the lower part, so that an upper part of the stamp is displaceable with the handle elements inserted in the lower part via the clearance.

Advantageous with the lateral positioning of the handle elements is that the user automatically exerts pressure on both opposite handle elements via the two fingers upon removal, and thus the stamp pad can be held securely by pressing the fingers together, so that said stamp pad can be simply and comfortably removed without coming in contact with the stamp ink.

With a further development, wherein the handle elements are so arranged that these protrude over a lateral surface of the carrying device for the secure lateral holding of the carrying device, it is achieved in an advantageous manner that through the protruding handle elements safe and secure handling is made possible. It also serves to achieve that with the stamp pad inserted it is easier to grasp by the user.

Also advantageous however is a design wherein the handle elements are unitarily formed with the carrying device or fastened to the carrying device via fastening means, as a result of which cost-effective unitary manufacture is created and on the other hand the handle elements are equipped removeably, so that the stamp pad can be used in older stamps without handle elements. Therefore only one kind of stamp pads have to be produced for different stamps.

The objects however are also solved through a stamp wherein the lower part for receiving and fixing a stamp pad are designed as described herein.

It is advantageous here that through the arrangement of the handle elements on the lateral surfaces a new type of removal method for self-inking stamps was created, wherein the stamp pad now has to be laterally gripped with at least two fingers. It is thus prevented that the user gets into the region of the pad saturated with ink, which with the prior art is frequently the case through puling out at the front or longitudinal surface of the stamp pad, since the user for improved grip frequently grasped the pads. A further advantage lies in that through the special arrangement of the means for fastening the stamp pad the stamp pad is now exactly positioned, since both a vertical as well as a horizontal force is exerted on the stamp pad. Because of this, use of a multi-colour stamp pad is also possible without problems.

With a design, wherein in the shaft or at least over a part region of a lateral surface a surface running at an angle is arranged on which a means for fixing a slid-in stamp pad is positioned, it is an advantage that exact positioning of a slid-in stamp pad is achieved, since a horizontal and a vertical force are exerted simultaneously, so that the stamp pad can no longer be displaced from the abutting stamp plate.

Also advantageous is a design, wherein in the shaft of the lower part on two lateral surfaces clearances for inserting a handle element of a stamp pad and for the lateral secure gripping and pulling out of the stamp pad are arranged, since improved handling when replacing a stamp pad is achieved as a result.

However, it is also advantageous that the lower part is formed of a plurality of parts, wherein a part in the region of a contact surface is designed transparently, since the user is able to look into the interior region of the stamp as a result, thus making possible better positioning of the stamp print.

Advantageous is a design wherein in the region of the contact surface of the lower part positioning protrusions are arranged so that the user is able to optimally position the stamp print.

With a design, wherein the upper part is formed of at least two parts, wherein one part is designed as decoration plate, it is advantageously achieved that during the assembly the decoration plate is separated from the upper part and thus the upper part can be easily fitted over the lower part.

These objects of the invention are solved through a stamp as described herein.

The objects are particularly solved in that the upper part encloses the lower past cap-like, wherein in the starting position a lower edge of the upper part runs below the opening in the lower part and that the upper part comprises a window associated with the opening, wherein in the starting position the window is located relative to the opening in the lower part in a position that is located higher than the opening, so that the opening is at least partially covered. Through this design, the carrying device is partially covered by a section of the front wall of the upper part and thus reliably held in position. Thus unintentional removal or falling out of the carrying device is prevented in the rest position of the stamp.

A further development according to which the window in the upper part extends over a width of a front wall and continues over a depth in side walls of the upper part has the advantage that access to the carrying device via the side walls is possible in a simple manner in that the carrying device is gripped laterally.

In order to hold the upper part in the position required for changing the carrying device, a further development according to which a lock is arranged on the upper part and a stop on the lower part, wherein the lock can be brought into engagement with the stop for fixing the window in a position orientated relative to the opening. The upper pert is pressed down by the required distance and the lock activated then, as a result of which the upper part remains in this position. After completion of the replacement process the lock is released and the upper pert returns into its rest position.

A further development can also consist in that the handles comprise an extension parallel to the insertion direction which corresponds to a depth of the opening in the lower part.

A further development according to which facing sides of the two handles are connected with the carrying device through engagement connections on narrow sides of the carrying device has the advantage that the lamp can be subsequently fastened to a universal carrying device in order to customize the latter for a specific stamp. An engagement connection particularly makes possible an arrangement of the clamp on the carrying device without additional connecting means being required for this purpose. This is also advantageous since the clamp in turn can be removed from the carrying device.

A further development of the clamp is additionally characterized in that on facing sides of the two handles a tooth profile and on the shorter narrow sides of the carrying device complementary to the tooth profiles, tooth profiles are formed. Thus, a positive connection of clamp and carrying device is guaranteed. In particular, good force transmission from the handles to the carrying device is additionally ensured when it is pulled out of the stamp and thus the risk of involuntary releasing of the clamp is prevented, while arbitrary releasing of the clamp is still possible.

Another further development consists in that the carrying device is formed with handles unitarily moulded on to its short narrow sides.

For strengthening the connecting seat between carrying device and clamp a further development is advantageous according to which the two handles in the direction of the adjacent long narrow side of the carrying device comprise a guide profile, which engages in a complementarily designed guide profile of the carrying device. Through this further development fastening of the handles via two adjoining narrow sides is achieved, which is advantageous for a reliable hold. In particular, such a further development is advantageous in that a clamp can also be fastened to the carrying device wherein the web connecting the two handles is not present or has insufficient mechanical stability in order to conned the handles adequately stable with the carrying device merely through fixing to or on the tooth profiles.

According to a further development the edge between bottom and short narrow side of the carrying device are designed as chamfer, which has the advantage that through a corresponding chamfer of complementary design the receiving device or the drawer faulty insertion of the carrying device becomes impossible. Particularly with a view to multi-colour stamp pads this has the additional special advantage that it can thus be ensured that the correct colour assignment to the stamp plate is also provided. For example, the two chamfers can have a different dimension for this purpose so that only correct insertion is possible.

For fixing the carrying device in the drawer or in the receiving device the chamfer can comprise an engagement position in which a suitably complementary catch of the receiving device or the drawer engages. Likewise, the chamfer can have a catch which engages into a complementary engagement position. This further development has the advantage that through the engaging the carrying device is held in its relative position and this engagement also provides clearly sensible feedback to the user when the carrying device is correctly aligned.

The objects of the invention are independently solved also in that the receiving device comprises means for reducing the contact pressure and for eliminating the contact between the stamp plate and the stamp pad. Through these means it is ensured that when changing the carrying device the contact pressure of the stamp plate against the stamp pad is reduced to the extent that removal of the carrying device largely subject to elimination of the friction between the two parts is achieved. According to a configuration of the stamp it is provided that removing the carrying device with the stamp pad is possible through a single manipulative action without for example having to bring the upper part into a suitable relative position. The means now ensures that the contact between stamp pad and stamp plate is cancelled, before a relative movement of stamp pad and stamp plate occurs. Through this configuration incorrect use is also largely avoided since the carrying device cannot be removed without activating the receiving device and thus the means beforehand so that the contact between stamp plate and stamp pad is cancelled.

According to a further development the means of the receiving device comprise a drawer that is displaceable in the shaft transversely to the vertical direction, i.e. according to a pushing-out direction, wherein the carrying device is displaceably held on the drawer corresponding to the pushing-out direction or a pushing-in direction. Through the design of a drawer a separation between function and service part is advantageously achieved. The drawer is a function part of the stamp and receives a replaceable consumption part, the carrying device.

A further development according to which the drawer is designed with an obliquely orientated ramp which is inclined with respect to the stamp pad and with respect to the pushing-in direction has the advantage that facilitated insertion of the carrying device in the drawer is achieved.

However, it is also advantageous with such a stamp that the operator has easy access to the drawer and that it can be easily gripped through the handles. The accurately fitted termination furthermore ensures that the movement of the upper part relative to the lower part can take place unhindered so that in particular the risk of getting wedged in during the movement of the upper part relative to the lower part is diminished.

The further development according to which the means of the receiving device comprise a pad lifter and a pusher which are movement-coupled with each other, wherein the stamp lifter is guided in the lower part displaceably parallel to the vertical direction by an adjusting travel, and wherein the pusher is displaceable in the shalt transversely to the vertical direction, that is corresponding to a pushing-out direction, has the advantage that by means of the pad lifter a defined movement of the stamp pad takes place and it is thus ensured that pad and stamp plate are separated or at least the pressing-on forces are largely removed before the carrying device is pulled out of the shaft. Thus this further development in turn is a part of the means for reducing the pressing-n pressure and for eliminating the contact between the stamp plate and the stamp pad.

In addition, the objects of the invention for a transport clamp are also solved in that on a bottom plate at least one tongue with a locking element arranged thereon is arranged, wherein the locking element establishes an engagement connection with the lower part through a window of the upper part.

Here it is advantageous that this does not present any visual impairment on the outer surface of the stamp since the engagement connection is made with the lower part which is pushed into the upper part. Thus, all protrusions, depressions etc. on the upper part required from the prior art can be omitted.

BRIEF DESCRIPTION OF THE DRAWINGS

To better understand the invention, it is explained in more detail by means of the following Figures.

It shows each greatly simplified in schematic representation:

FIG. 10 a stamp according to FIG. 15 with stamp partly pulled out of the lower part shown perspectively;

DETAILED DESCRIPTION

Figure 1:
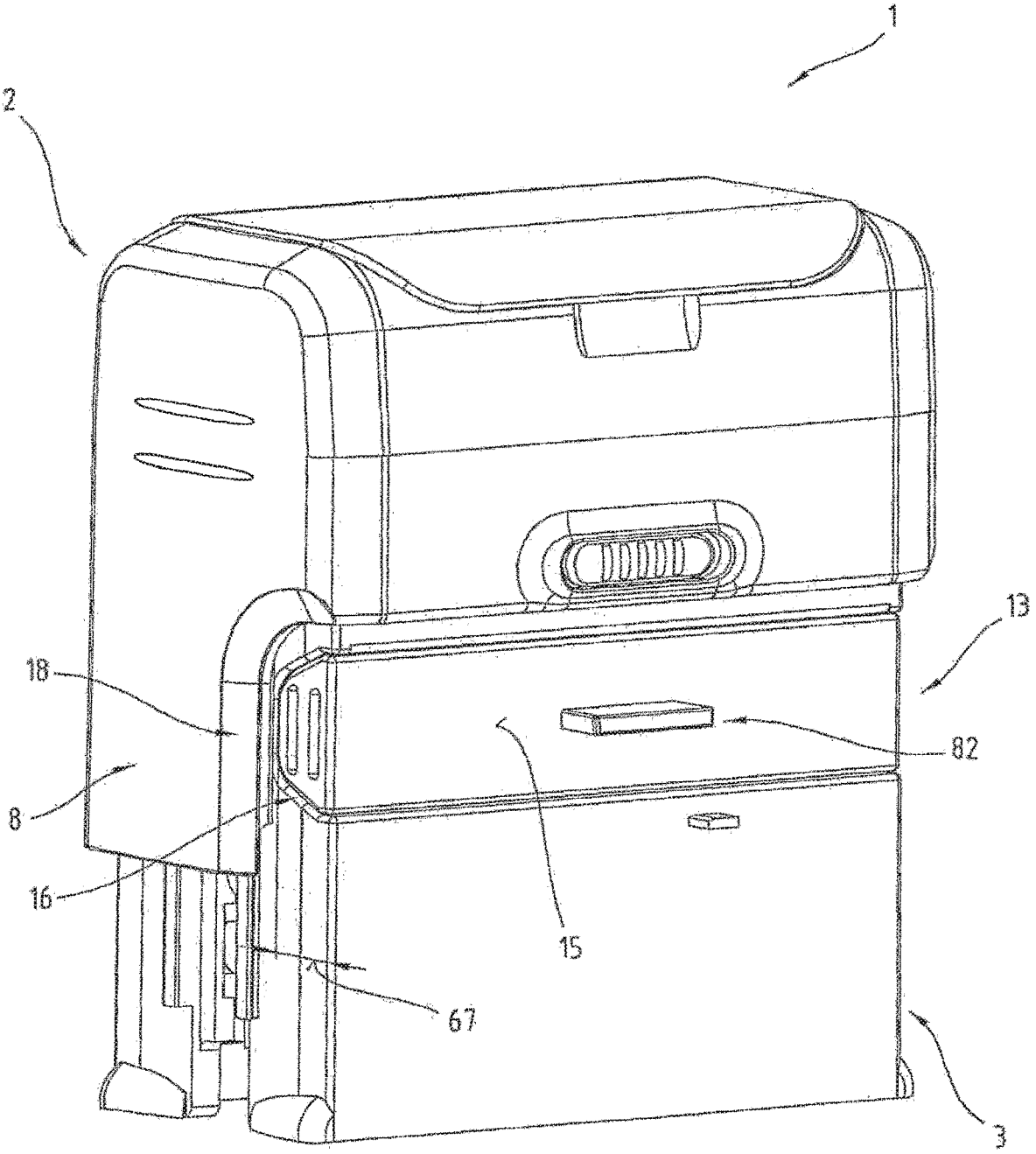
FIG. 1 a stamp according to a first exemplary embodiment in perspective view.

By way of introduction be it recorded that in the various embodiments described same parts are provided with same reference characters or same component designations, wherein the disclosures contained in the entire description can be transferred accordingly to same parts with same reference characters or same component designations. The position specifications selected in the description such as top, bottom, lateral etc. relate to the directly described and represented figure and have to be transferred to the new position accordingly upon a position change. In addition, individual features or feature combinations from the various exemplary embodiments shown and described can represent by themselves solutions which are independent, inventive or in accordance with the invention.

All details regarding value ranges in the concrete description are to be understood in that these comprise any and all part ranges there from, e.g. the statement 1 to 10 are to be understood in that all part ranges starting from the lower limit 1 and the upper limit 10 are included, that is al part ranges start with a lower limit of 1 or greeter and end with an upper limit of 10 or smaller, e.g. 1 to 1.7, or 3.2 to 8.1 or 5.5 to 10.

FIG. 1 shows a stamp 1 designed according to the invention according to a first exemplary embodiment in perspective view. This is a so-called self-inking stamp wherein an upper part 2 and a lower part 3 are guided on each other telescopically and the stamping operation is performed by pressing down the upper part 2 or the handle of the stamp 1 relative to the lower part 3. Here, the pressing-down or compressing of the upper part 2 relative to the lower part 3 takes place against the resetting force of a spring (not shown) arranged in the interior of the upper part 2 between the upper part 2 and the lower part 3.

Figure 2:
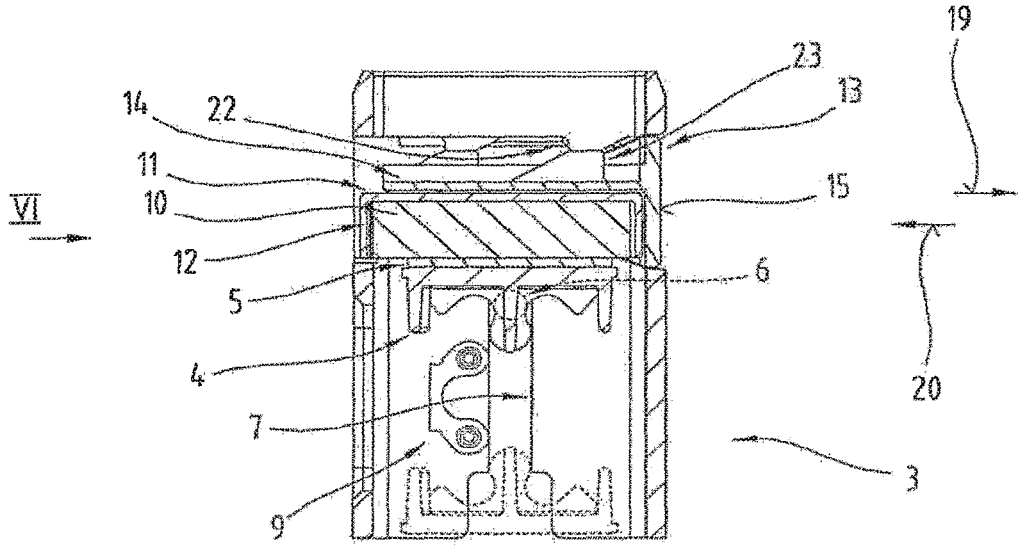
FIG. 2 a cross section of the lower part of the stamp according to FIG. 1.

FIG. 2 shows a cross section of the lower part 3 of the stamp 1 according to FIG. 1. The sectional lower part 3 is perspectively shown in FIG. 3. Within the lower part 3 an adjustable printing plate carrier 4 with a stamp plate 5 is arranged. To this end, the printing plate carrier 4 comprises axle pins 6 which are vertically displaceable in the vertical guides 7 formed in the side walls of the lower part 3. The axle pins 6 of the printing plate carrier 4 reach through the vertical guides 7 on both sides of the lower part 3 and are rotatably mounted in a manner known per se in side walls 8 of the upper part 2 of the stamp 1. In the lower part 3 a reversing mechanism 9 likewise known from the prior art is additionally formed with which the printing plate carrier 4 upon its movement along the vertical guide 7 can be brought into engagement, so that the printing plate carrier 4 simultaneously has to execute a rotary movement and in this manner arrives in a position swiveled by 180°. The stamp plate 5 with the printing plate carrier 4 is thus adjustably mounted through the reversing mechanism 9 in the lower part 3 of the stamp 1 in a limited translatoric as well as limited rotatoric manner. Through the guidance of the axle pins 6 in the vertical guides 7 of the lower part 3 and the simultaneous mounting of the axle pins 6 in the side walls 8 or the upper part 2 there is a compulsory movement coupling when pressing down the upper part 2 between the upper part 2 and the stamp plate 5 or the printing plate carrier 4. The stamp plate 5 thus performs in a defined manner a change between a lower lying position, a printing position, in which the stamp plate 5 comes in contact with a surface to be stamped (shown in interrupted lines in FIG. 2) and on the other hand a position swiveled by 180°, a rest position, in which the stamp plate 5 is in contact with a stamp pad 10 arranged in the lower part 3 and ink is thus transferred from the stamp pad to the stamp plate.

Further Development: Link Guide

Figure 3:
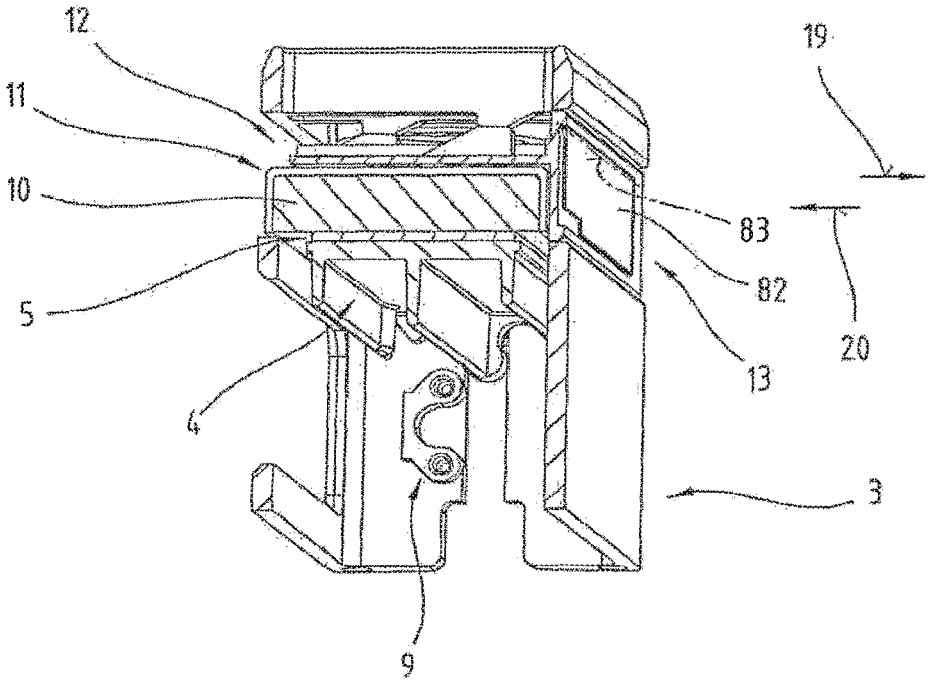
FIG. 3 a cross section of the lower part of the stamp according to FIG. 2 shown perspectively.

The position of the printing plate carrier 4 or the stamp plate 5 shown in FIGS. 2 and 3 corresponds to the rest position or starting position in which the stamp plate 5 contacts the stamp pad 10 with a defined pressing-on pressure. The stamp pad 10 consists of a sponge-like material capable of storing and is thus suitable to stare and dispense a certain supply of stamping ink to the stamp plate 5 over a longer period. To arrange the stamp pad 10 in the stamp 1 it is mounted or fastened in a frame or box-like carrying device 11.

The carrying device 11 jointly with the stamp pad 10 forms a replaceable unit. To this end, a shaft 12 is formed in the upper marginal region of the lower part 3 in which the carrying device 11 with the stamp pad 10 is inserted. The shaft 12 is preferably designed as a break-through which extends transversely to the longitudinal extension of the lower part 3 or transversely to the actuation direction of the stamp 1 according to the vertical guide 7. To arrange or position the carrying device 11 with the stamp 10 in the shaft 12 in a position contacting the stamp plate 5 the carrying device 11 is held on a drawer 13. According to the situation shown, wherein the stamp plate 5 from the bottom bears against and is pressed against the freely accessible side of the stamp pad 10 facing down, both the box-like carrying device 11 as well as the drawer 13 are arranged in the shaft quasi "upside down".

The lower part 3 of the stamp 1 thus constitutes a housing-like receiving device for the carrying device 11 with the stamp pad 10 arranged on the drawer 13. The lower part 3 has a substantially hollow prismatic shape wherein in the face end region located opposite or facing away from the shaft 12 a break-through or an opening is provided, whose cross section at least corresponds to the size or the cross section of the printing plate 5 or the printing plate carrier 4. In the position of the stamp plate 5 for creating a stamp imprint it reaches through the break-through or can even slightly protrude over this break-through.

Figure 4:
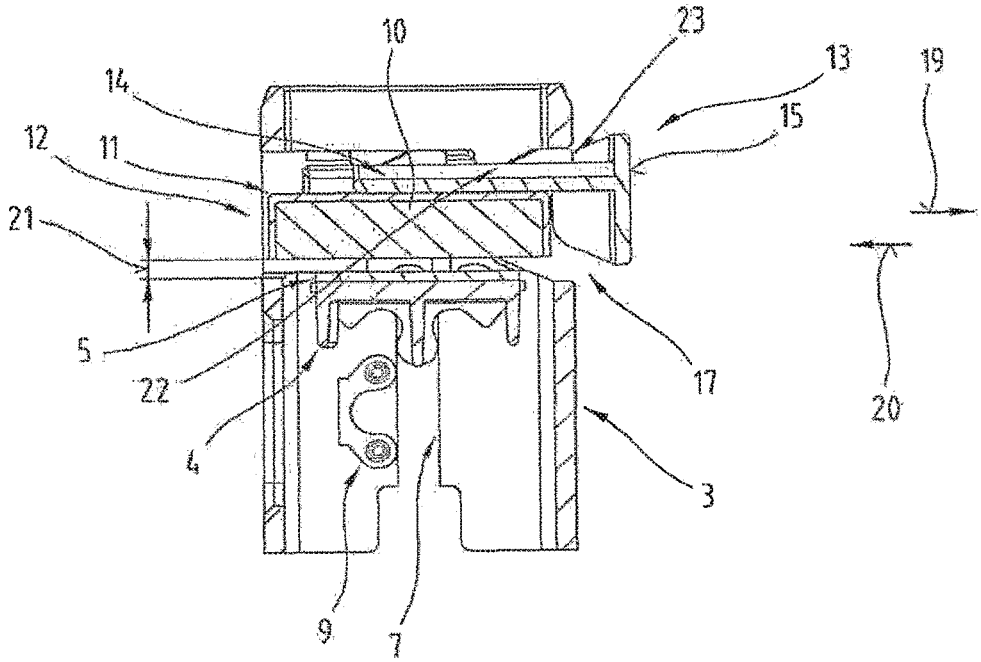
FIG. 4 a cross section of the lower part of the stamp with the drawer in the position partly pushed out of the shaft.
Figure 5:
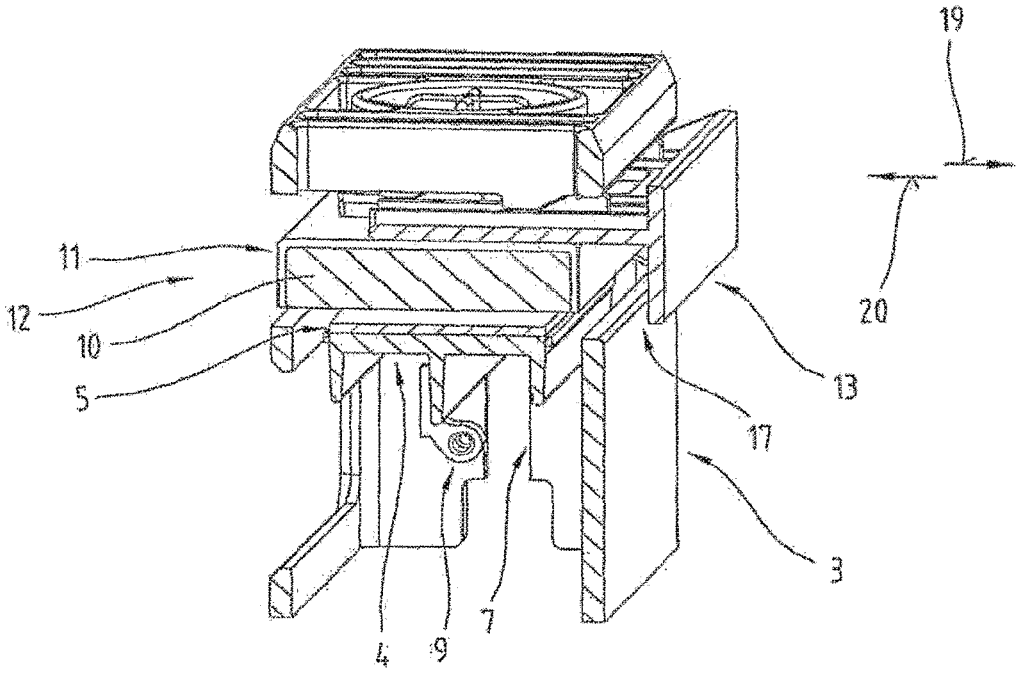
FIG. 5 the sectionalized lower part according to FIG. 4 shown perspectively.

The operation of the receiving device for the carrying device 11 with the stamp pad 10 in the lower part 3 of the stamp 1 is more clearly illustrated through comparing the representations according to FIGS. 2 and 3 on the one hand and FIGS. 4 and 5 on the other hand.

FIG. 4 shows a cross section of the lower part 3 of the stamp 1 with the drawer 13 in the position partly pushed out of the shaft 12.

FIG. 5 perspectively shows the sectional lower part according to FIG. 4. The drawer 13 comprises a base plate 14, a front side 15 and on both sides of the front side 15 and following in each case a handle 16 (FIG. 1). In the position of the drawer 13 pushed into the shaft 12 an opening 17 provided in the lower part 3 is closed preferentially in an accurately fitting manner through the front side 15 and the handles 16 of the drawer 13, so that a largely flat front is created as is shown in FIG. 3. On the other hand, a clearance 18 (FIG. 1) is provided in the cap-like upper part 2 of the stamp 1 in the region of the front side 15 or in the region of the handles 16. The clearance 18 preferentially extends in the side wall 8 of the upper part 2 corresponding to a depth 67 of the laterally arranged handles 16. The drawer 13 can thus be gripped with the fingers by its handles 16 and pulled and removed from the shaft 12 in accordance with a pushing-out direction 19. Conversely, reinserting the stamp pad 10 is performed in that the drawer 13 is pushed into the shaft 12 of the lower part 3 corresponding to a pushing-in direction 20. The opening 17 shaped in the lower part 3 in accordance with the shaft 12 simultaneously serves as stop up to which the drawer 13 can be pushed into the shaft 12. This stop is more preferably formed through the limitations of the opening 17 in the lower part 3 corresponding to the handles 16.

In a further development a handle 82 can also be arranged on the front side 15 of the drawer 13. As shown in FIG. 1, this handle 82 can also be formed through a protruding moulded part but it is also possible to form this handle in a manner capable of being folded out or swiveled out so as to form as flat as possible a front side 15, but to have available an easy-to-grip handle for removing the drawer 13. In FIG. 3 a handle 82 that can be folded out is shown for example that can be swiveled about a swivel axis 83 and upon non-actuation is held in a folded-in rest position through design measures such as knobbles in the region of the swivel axis. Furthermore it is possible for the front side 15 of the drawer 13 to comprise an elastic strap which in a rest position bear on the front side and can be lifted if required.

As is evident from the comparison of the relative positions of the drawer 13 according to FIGS. 2 and 4 a displacement in vertical direction also occurs when puling out the drawer 13 corresponding to the pushing-out direction 19. i.e. in a direction parallel to the vertical guide 7, wherein the drawer 13 with the stamp pad 10 is lifted by a height 21. In order to make this possible, at least one ramp 22 that can be brought in engagement with the drawer 13 is provided in the shaft 12 of the lower part 3. Preferentially, a plurality of such ramps 22 formed with an inclined surface and corresponding to these, a plurality of ramps 23 located opposite the ramps 22 are formed on the base plate 14 of the drawer 13. The ramps 23 are arranged on the top of the base plate 14 and protrude upwards in the direction of the ramps 22 arranged opposite and protruding downwards. The ramp pairs 22, 23 can for example also be arranged parallel to the front side 15 offset relative to each other, as a result of which supporting on a larger area is possible.

The relative arrangement of the carrying device 11 with the stamp pad 10 and the printing plate carrier 4 with the stamp plate 5 in the lower part 3 as shown in the representation according to FIG. 2 is selected so that the stamp plate 5 with at least a minor pre-stress presses against the stamp pad 10. This is also required in order to make possible wetting of the stamp plate 5 with stamp ink. Accordingly, the ramps 22, 23 are located in an arrangement pressed against each other. On pulling out the stamp pad 10 with the drawer 13, the sliding-off of the ramps 22 and 23 on each other which with respect to the direction of the vertical guide 7 takes place obliquely makes possible lifting-off of the stamp pad 10 from the stamp plate 5. Here, unloading of the stamp pad 10 takes place in that the latter elastically springs back from the compressed state. The reduction of the pressing-on pressure between the stamp plate 5 and the stamp pad 10 connected with this thus makes it possible that the stamp pad 10 can be removed from the shaft 12 subject to the avoidance of friction resistance as far as possible. Dependent on the elasticity of the stamp pad 10 the elastic recovery of said stamp pad can be more or less pronounced and even entirely absent. Through the sliding-off of the ramps 22, 23 on each other however a reduction of the pressing-on pressure of the stamp plate 5 against the stamp pad 10 will always occur so that the puling out of the drawer 13 is at least facilitated.

Figure 6:
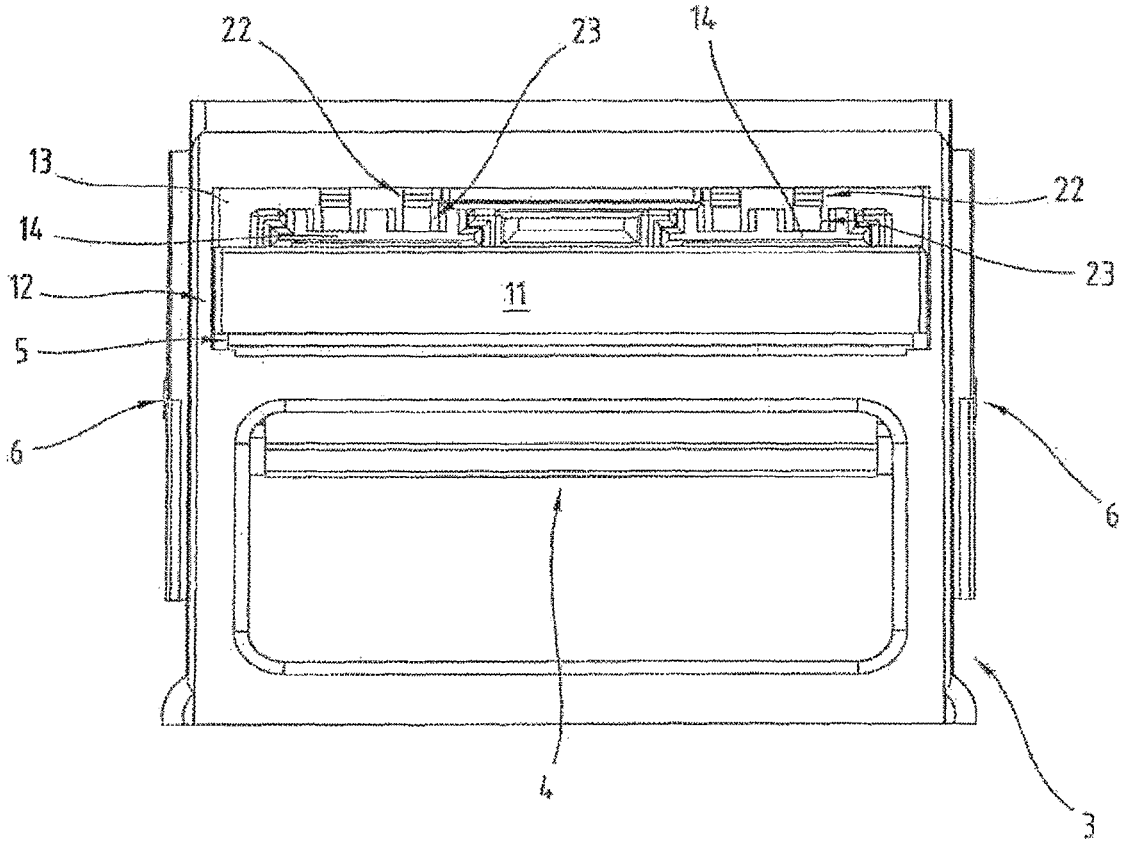
FIG. 6 a rearward view of the lower part of the stamp according to FIG. 2 (viewing direction parallel to the pushing-out direction of the stamp pad)
Figure 7:
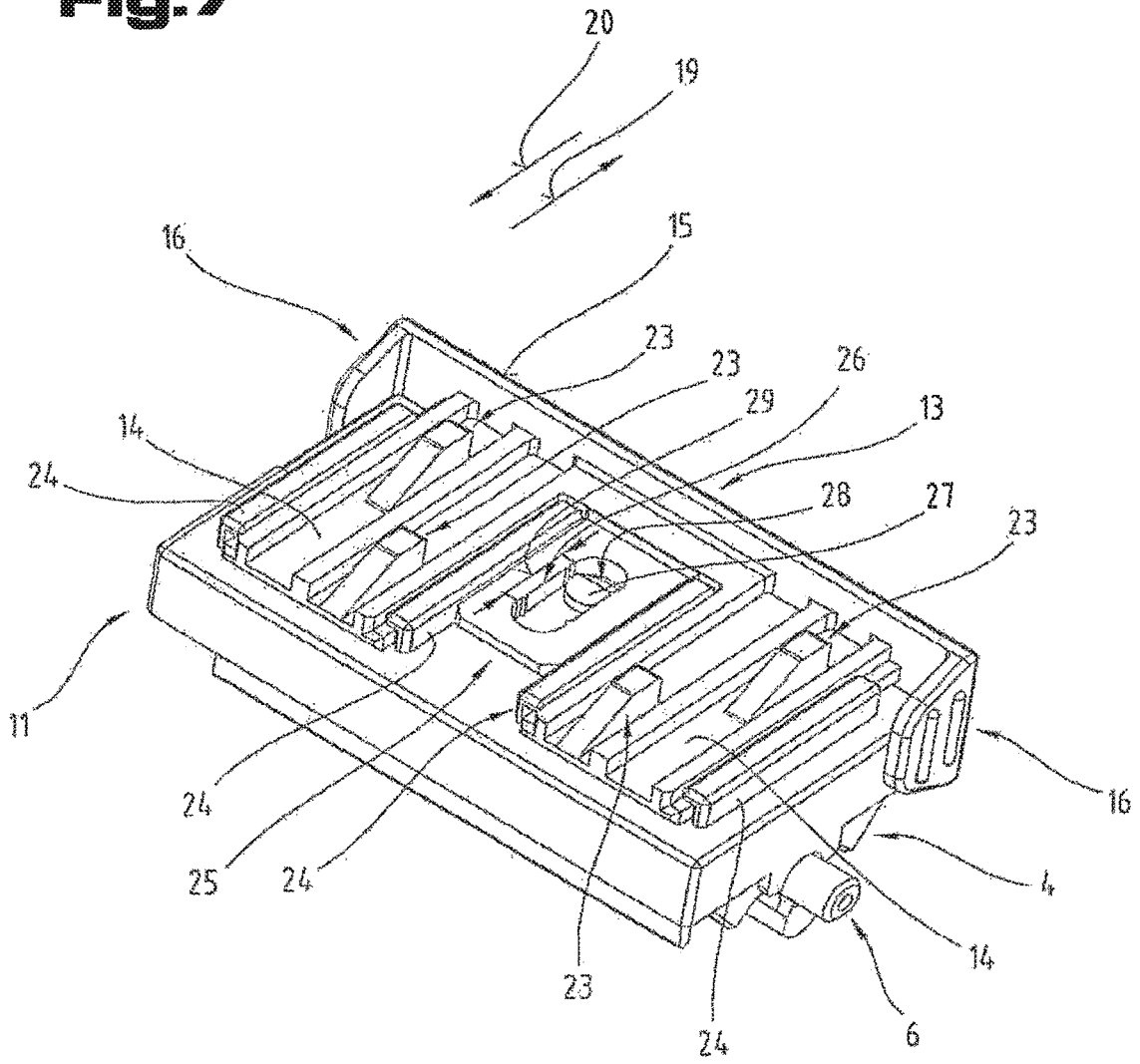
FIG. 7 the arrangement of the drawer, the stamp pad and the printing plate carrier in the position according to FIG. 1 shown perspectively.

The interaction of the carrying device 11 of the stamp pad 10 with the drawer 13 for inserting or removing from the shaft 12 of the lower part 3 of the stamp 1 is explained in more detail in the following by means of FIGS. 6 and 7. FIG. 6 shows a view of the lower part 3 according to FIG. 2, that is according to a viewing direction parallel to the pushing-out direction 19. Here, the carrying device 11 of the stamp pad 10 and the drawer 13 are located in their position inserted or pushed into the shaft 12 of the lower part 3. A perspective detail view is shown in FIG. 7, wherein for improved clarity only the printing plate carrier 4, the carrying device 11 of the stamp pad 10 and the drawer 13 are shown. According to this exemplary embodiment the drawer 13, as already described, comprises the front side 15, two laterally arranged handle parts 16 and—according to this exemplary embodiment—two base plates 14 connected with the front side 15, which substantially extend parallel to the pushing out and pushing-in direction 19, 20 respectively. On the two base plates 14 two ramps 23 each offset from each other with respect to the pushing-out direction 19 are arranged, which are in engagement with the ramps 22 arranged in the shaft 12 of the lower part 3. Between the drawer 13 on the one hand and the carrying device 11 of the stamp pad 10 on the other hand at least one guide with a relative position parallel to the pushing-out direction 19 is provided. According to this exemplary embodiment, two guides are provided which on the one hand are formed through L-shaped guide profiles 24 of the carrying device 11 and engage behind the lateral edges of the base plates 14. To limit the adjusting travel along these guides stops can be provided between the drawer 13 and the carrying device 11. To this end, the drawer 13 preferentially comprises a driver strap 25 with an elongated hole 26 into which a driver pin 27 provided on the carrying device 11 protrudes. Like the two base plates 14, the driver strap 25 of the drawer 13 is arranged substantially orientated parallel to the pushing-out direction 19 and standing away from the front side 15. An end region of the driver strap 25 facing away from the front side 15 is elastically deformable so that it can be lifted via the driver pin 27 on joining the drawer 13 with the carrying device 11, so that the driver pin finally comes to lie in the elongated hole 26 of the driver strap 25. This engaging of the driver pin 27 in the elongated hole 26 can be additionally supported in that on the driver pin 27 a bevel 28 orientated parallel to the pushing-out device 19 is provided.

In that the elongated hole extends in a direction parallel to the pushing-out direction 19 over a length 29, this length 29 is also available to the driver pin 27 as adjusting travel within the elongated hole 26. Because of the friction force connected with the higher pressing-on pressure between the stamp plate 5 and the stamp pad 10 the carrying device 11 of the stamp pad 10 on removing the drawer 13 from the shaft 12 is thus initially held in its original position (FIG. 4, 5). With progressing movement of the drawer 13 along the pushing-out direction 19 a reduction of the pressing-on pressure between the stamp plate 5 and the stamp pad 10, due to the relative adjustment corresponding to the sliding-off of the stamps 22 and 23 on each other as well as a movement of the driver pin 27 over the length 29 of the elongated hole 26 simultaneously takes place. Since the relative movement between the carrying device 11 and the drawer 13 is limited by the length 29 of the elongated hole 20 the carrying device 11 of the stamp pad 10 is finally pulled out of the shaft 12 with the drawer 13 upon progressing movement of said drawer. Only after the lifting of the driver strap 25 can the limitation of the adjusting travel of the driver pin 27 be cancelled and the carrying device 11 finally separated from the drawer 13. Thus replacing of the carrying device 11 with the stamp pad 10 is possible. For reinserting the drawer 13 with the carrying device 11 the movement sequence described has to be carried out in reverse order.

A special advantage with the described solution of the stamp 1 is that the removing of the carrying device 11 with the stamp pad 10 is substantially simplified for the user. Having grasped the drawer 13 by the two handles 16 a single movement—namely puling out the drawer 13 corresponding to the pushing-out direction 19—is sufficient to remove the stamp pad 10 from the stamp 1. No other manipulation on the stamp 1 whatsoever is thus required. Through the limitation of the relative movement of the driver pin 27 of the carrying device 11 in the elongated hoe 26 of the driver strap 25 it is additionally ensured that the carrying device 11 with the stamp pad 10 cannot fall to the ground in an uncontrolled manner. The usually high contamination risk when changing stamp pads 10 can thus also be reduced substantially.

Figure 8:
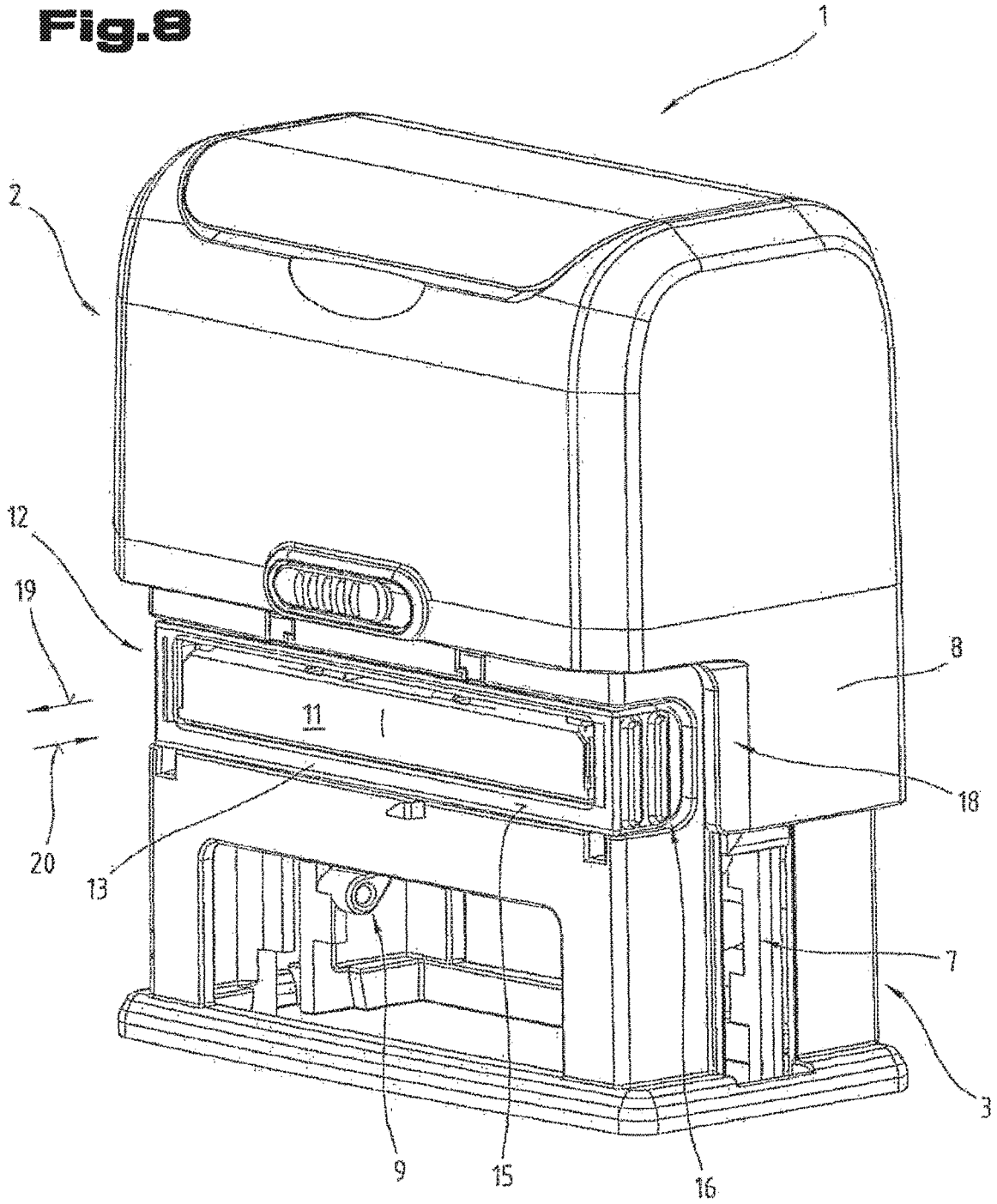
FIG. 8 a further exemplary embodiment of the stamp shown perspectively.
Figure 9:
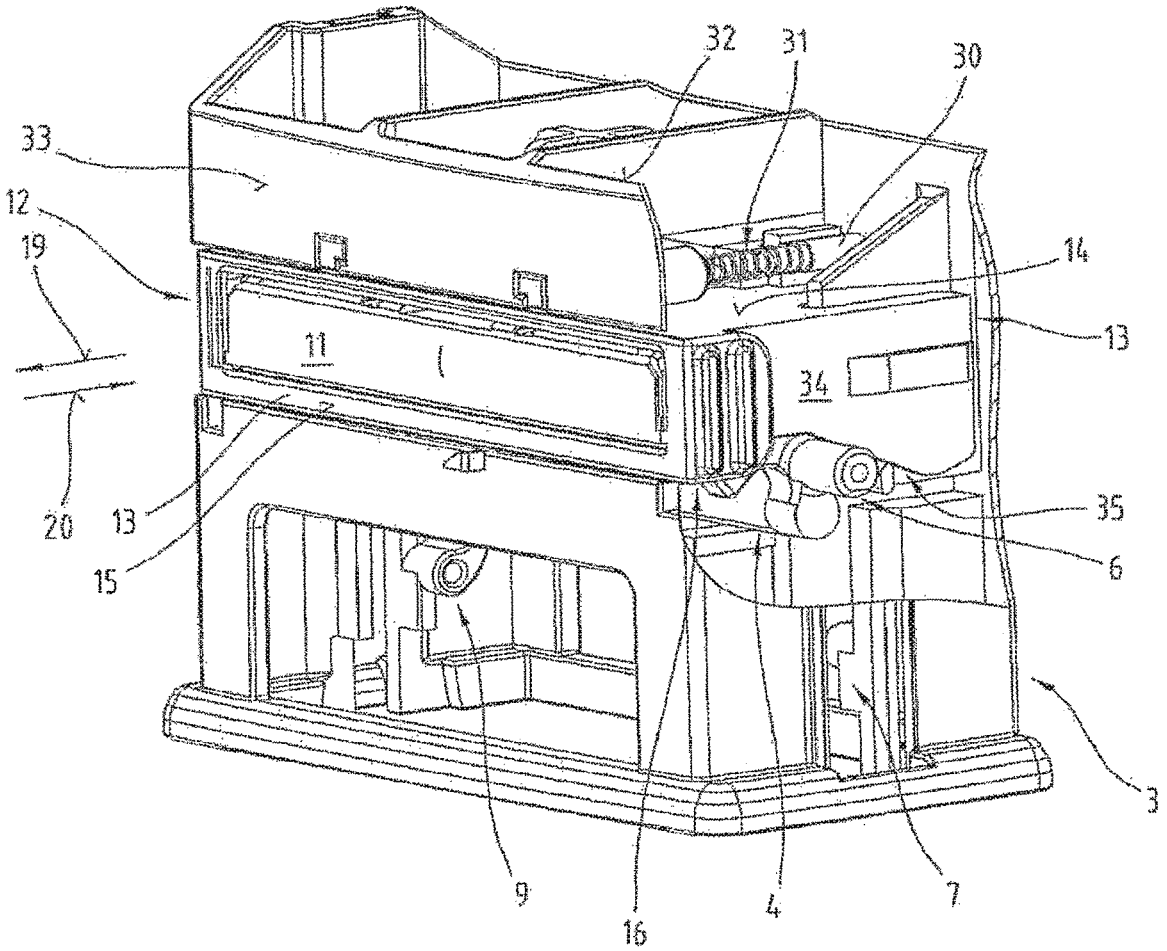
FIG. 9 the tower part of the stamp according to FIG. 8 shown perspectively and pertly sectionalized.
Figure 10:
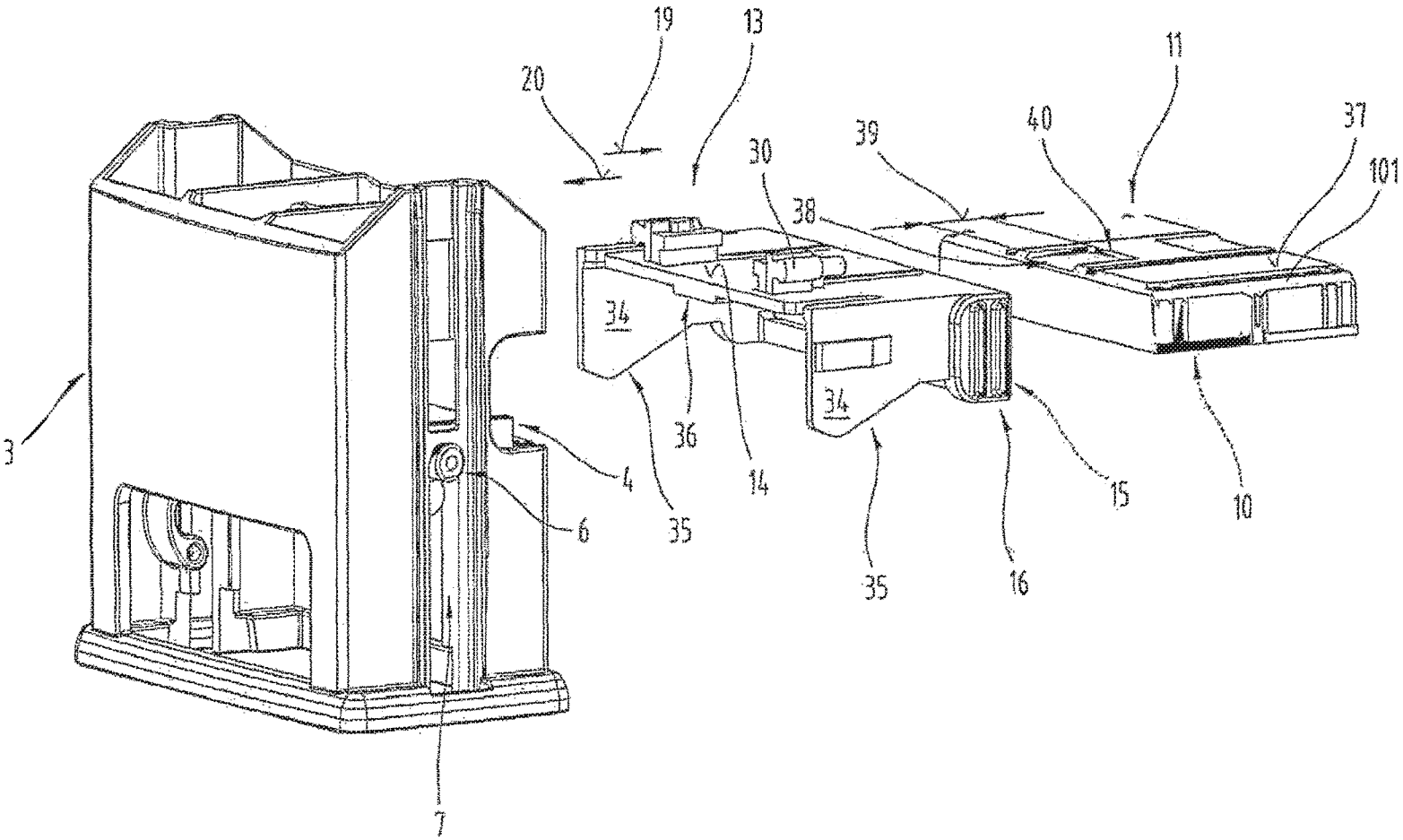
FIG. 10 the lower part, the drawer and the carrying device of the stamp pad of the stamp according to FIG. 8 in exploded representation.

FIG. 8 to 10 show a further exemplary embodiment of a stamp 1 with a carrying device 11 of a stamp pad 10, which is inserted in the lower part 3 of the stamp 1 with the help of a drawer 13 with an opening for the carrying device 11. The drawer 13 according to this exemplary embodiment likewise comprises laterally arranged handles 16 following the front side 15. Thus the drawer 13 can be grasped by the user and jointly with the carrying device 11 of the stamp pad 10 removed from the lower part 3 of the stamp 1 in the direction of the pushing-out direction 19. The shaft 12 in the lower part 3 for receiving the drawer 13 with the stamp pad 10 is also orientated transversely or vertically with respect to the vertical guide 7 for the axial pins 8 of the printing plate carrier 4 with this exemplary embodiment of the stamp 1.

FIG. 9 shows the lower part 3 of the stamp 1 in perspective view and partially sectionalized. On the base plate 14 of the drawer 13, bearing elements 30 for springs 31 supporting themselves thereon are provided. These springs on the other hand support themselves against an inner side 32 of a frontal housing wall 33 of the lower part 3. In the position of the drawer 13 shown according to FIG. 9 the springs 31 are pre-stressed and the drawer 13 is held or held back in the position pushed into the interior shaft 12 as a result.

On both of their sides the base plate 14 of the drawer 13 is followed by a side wall 34 standing parallel to the pushing-out or pushing-in direction 19, 20 and perpendicularly to the base plate 14. The base plate 14 and the two side walls 34 thus form a U-shaped encasement of the carrying device 11 of the stamp pad 10. The side walls 34 facing away from the base plate 14 in a downward direction have a limitation in form of an obliquely orientated ramp 35. The ramp 35 is orientated obliquely sloping downwards with respect to the pushing-in direction 20 and otherwise so dimensioned that it is in engagement with the axle pin 6 of the printing plate carrier 4. In the position of the drawer 13 fully pushed into the shaft 12 (as shown in FIG. 9) the stamp pad 10 and the stamp plate 5 are in contact and in a position pressed against each other. However, if the drawer 13 is displaced in the shaft 12 corresponding to the pushing-out direction 19 the sliding-off of the ramp 35 on the axle pin 8 of the printing plate carrier 4 results in that the stamp plate 5 and the stamp pad 10 are unloaded and finally distanced from each other. As a consequence, the carrying device 11 of the stamp pad 10 can be pulled out and removed from the lower part 3 of the stamp 1 subject to the avoidance of a friction resistance as far as possible.

FIG. 10 shows the lower part 3, the drawer 13 and the carrying device 11 of the stamp pad 10 in an exploded representation. In the end region of the base plate 14 facing away from the front side 15 of the drawer 13 a driver lug 36 protruding into the movement space of the carrying device 11 is formed. Corresponding to or aligned with the driver lug 36 a groove-like clearance 38 is formed in a bottom 37 of the carrying device 11 of the stamp pad 10. This clearance 38 is open towards the edge of the carrying device 11 and extends over a length 39 as far as to a stop 40 parallel with a pushing-out or pushing-in direction 19, 20.

On pulling the drawer 13 out of the lower part 3 of the stamp 1 the carrying device 11 initially remains in a position held back in the lower part 3 because of the back pressure of the stamp plate 5 against the stamp pad 10 or because of the adhesive friction. Through the movement of the drawer 13 along the pushing-out direction 19 the contact pressure between the stamp plate 5 and the stamp pad 10 is reduced on the one hand because of the action of the ramp 35 on the axle pin 6 of the printing plate carrier 4 and on the other hand the driver lug 36 having covered the distance of the length 39 in the clearance 38 cones into engagement with the stop 40 of the carrying device 11. With progressing movement of the drawer 13 along the pushing-out direction 19 the carrying device 11 is then also puled out further.

With progressing puling-out of the drawer 13 the springs 31 (FIG. 9) are simultaneously compressed and as a consequence of this the resetting force acting in pushing-in direction 20 becomes ever greater so that the drawer 13 as soon as released is again pulled back into the shaft 12 along the pushing-in direction 20 with an accelerating movement. In the process, the carrying device 11 of the stamp pad 10 because of its inertia cannot follow this accelerated movement of the drawer 13 quickly enough and finally remains in a position wherein the carrying device 11 at least partially protrudes over the front side 15 of the drawer 13 in the direction of the pushing-out direction 19. Thus the carrying device 11 of the stamp pad 10 can be finally puled out and removed from the drawer 13.

For inserting a new carrying device 11 of a stamp pad 10 the drawer 13 is initially puled out of the shaft 12 in the direction of the pushing-out direction 19, wherein the printing plate carrier 4 through displacement of the axle pins 6 in the vertical guide 7 is pushed downward. In this pulled-out position of the drawer 13 the carrying device 11 is then pushed into the drawer 13 along the pushing-in direction 20 until the stop 40 of the carrying device 11 comes to bear against the driver lug 36 of the drawer 13. Here, the carrying device 11 is located n position pushed further into the shaft 12 relative to the drawer 13 then would correspond to the front side 15 of the drawer 13. Through further pushing-in of the drawer 13 into the shaft 12 of the lower part 3 the carrying device 11 of the stamp pad 10 then reaches its working position located above the stamp plate 5 of the printing plate carrier 4 and in the process is subjected to the pressing-on pressure of the stamp plate 5 once the upward movement of the axle pin 6 of the printing plate carrier 4 in the vertical guide 7 is again released by the ramps 35 of the drawer 13.

Figure 11:
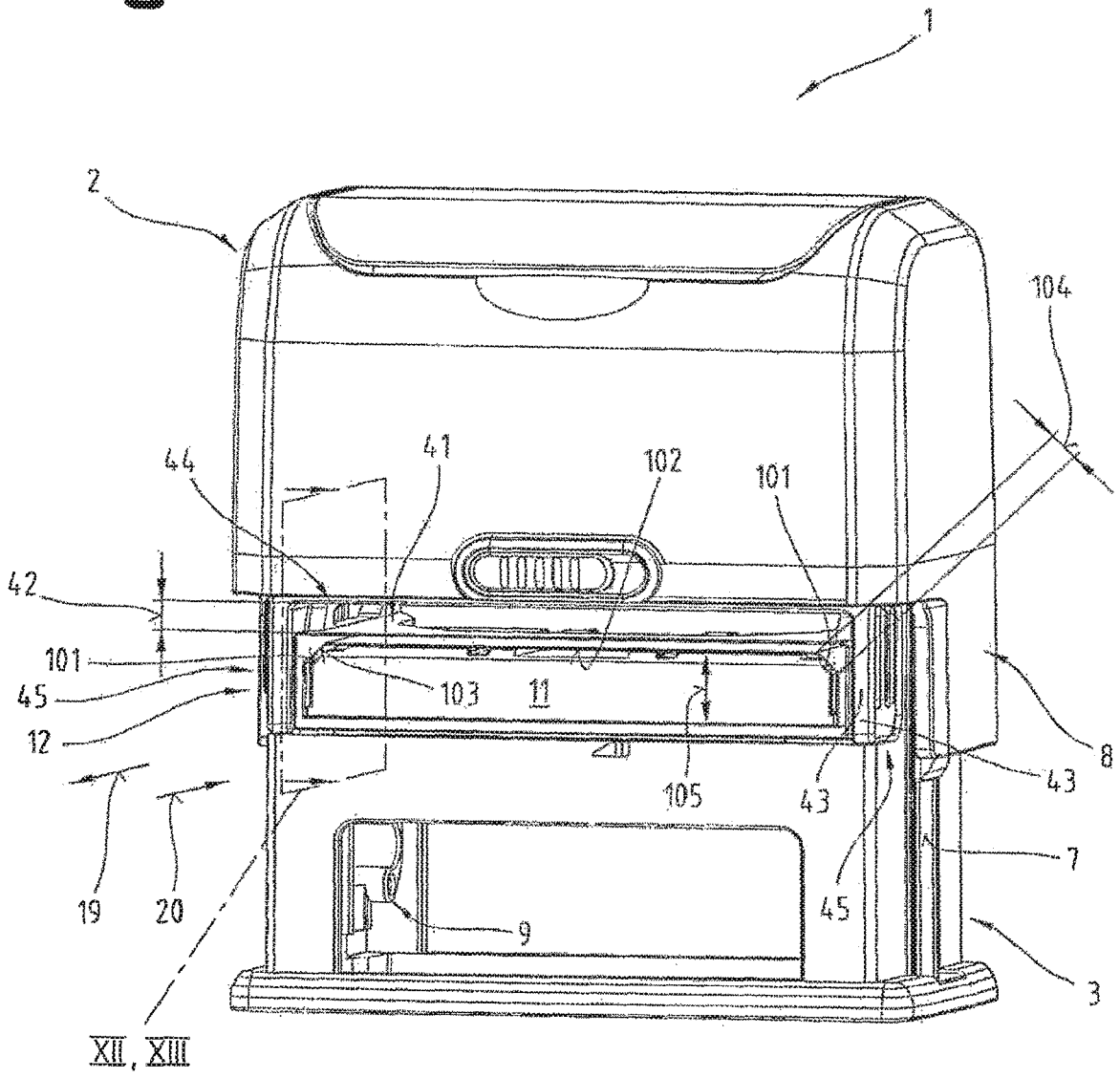
FIG. 11 an alternative exemplary embodiment of the stamp with a lifting mechanism for the carrying device of the stamp pad.

FIG. 11 to 14 show an alternative exemplary embodiment of a stamp 1 according to the invention with a lifting mechanism for the carrying device 11 of the stamp pad 10. FIG. 11 shows a perspective view of the stamp 1, wherein the carrying device 11 of the stamp pad 10, inserted in a pad lifter 41, is held in the shaft 12 of the lower part 3 of the stamp 1.

The pad lifter 41 on the one hand forms a shaft-like receptacle 102 and guideway for the carrying device 11 of the stamp pad 10 that can be inserted and pushed out from there.

On the other hand, the pad lifter 41 is designed to bring about a vertical displacement by an adjusting travel 43 parallel with respect to the vertical guide 7 relative to the lower part 3 of the stamp 1. To this end, the pad lifter 41 is adjustably guided in the lower part 3 of the stamp 1 in vertical direction.

With the carrying device 11 according to this exemplary embodiment it is provided that the transitions from the bottom 37 to the shorter narrow sides of the carrying device 11 are each formed by a chamfer 101 orientated parallel to the pushing-out or pushing-in direction 19, 20. The shaft-like receptacle 102 and guideway in the pad lifter 41 are also formed corresponding to the chamfer 101 on the carrying device 11. This means the receptacle 102 for the carrying device 11 in its upper lateral marginal regions comprises an obliquely orientated inner chamfer 103. The inclination as well as the size of the inner chamfer 103 and the chamfer 101 are selected corresponding to each other. The amount of the angle of the inclination of the chamfer 101 as well as of the inner chamfer 103 is preferentially 45°. A chamfer width 104 of the inner chamfer 103 preferentially has a value between 10% and 70% of a height 105 of the receptacle 102. Providing the inner chamfer 103 of the receptacle 102 in the pad lifter 41 and the chamfer 101 on the carrying device 11 has the advantage compared with a carrying device 11 with rectangular cross section that faults during insertion of a carrying device 11 to be replaced are prevented. For the carrying device 11 can thus only be pushed—functionally correct—into the receptacle 102 with the stamp pad 10 facing down. A further restriction of the possibilities for sliding the carrying device 11 into the receptacle 102 of the pad lifter 41 is also offered by an alternative embodiment, wherein an inner chamfer 103 and also a chamfer 101 are provided on one side of the carrying device 11 respectively. Further alternative exemplary embodiments of the carrying device 11 or the receptacle 102 could be the choice of inclination angles relative to each other or different chamfer widths 104 on the two sides of the chamfer 101 or the inner chamfer 103. A further advantage of the chamfer 101 of the carrying device 11 consists in the inherent stability of the carrying device 11 increased thus. In particular, the two corresponding chamfers 101, 103 can also have other geometrical shapes. In addition to the bevel shown radii and/or polygonal drafts are also conceivable in order to achieve a preferably simple and more preferably unambiguous insertion of the carrying device and a low jamming tendency. More preferably the chamfer 101 can for example comprise a rise on the carrying device 11 so that through the sliding-in 20 of the carrying device automatic alignment of the carrying device 11 relative to the receptacle 102 is achieved. In addition, improved vertical support of the carrying device 11 on the side wall of the pad liter or the lower part can be achieved with the chamfer.

The adjustment of the pad lifter 41 jointly with the carrying device 11 of the stamp pad 10 is brought about through a pusher 43 likewise jointly arranged in the shaft 12 of the lower part 3, which to this end is engaged with ink paths 44 of the pad lifter 41. As will be described in more detail in the following by means of FIGS. 12 and 13, the stamp lifter 41 and the pusher 43 jointly form the lifting mechanism for the adjustment of the carrying device 11 of the stamp pad 10 mentioned at the outset. The lifting of the pad lifter 41 in this case is effected by pulling out the pusher 43 in the direction of the pushing-out direction 19. The pusher 43 to this end is designed with handles 45 by which t can be grasped with the fingers and which laterally enclose the pad lifter 41 on its narrow sides.

Figure 12:
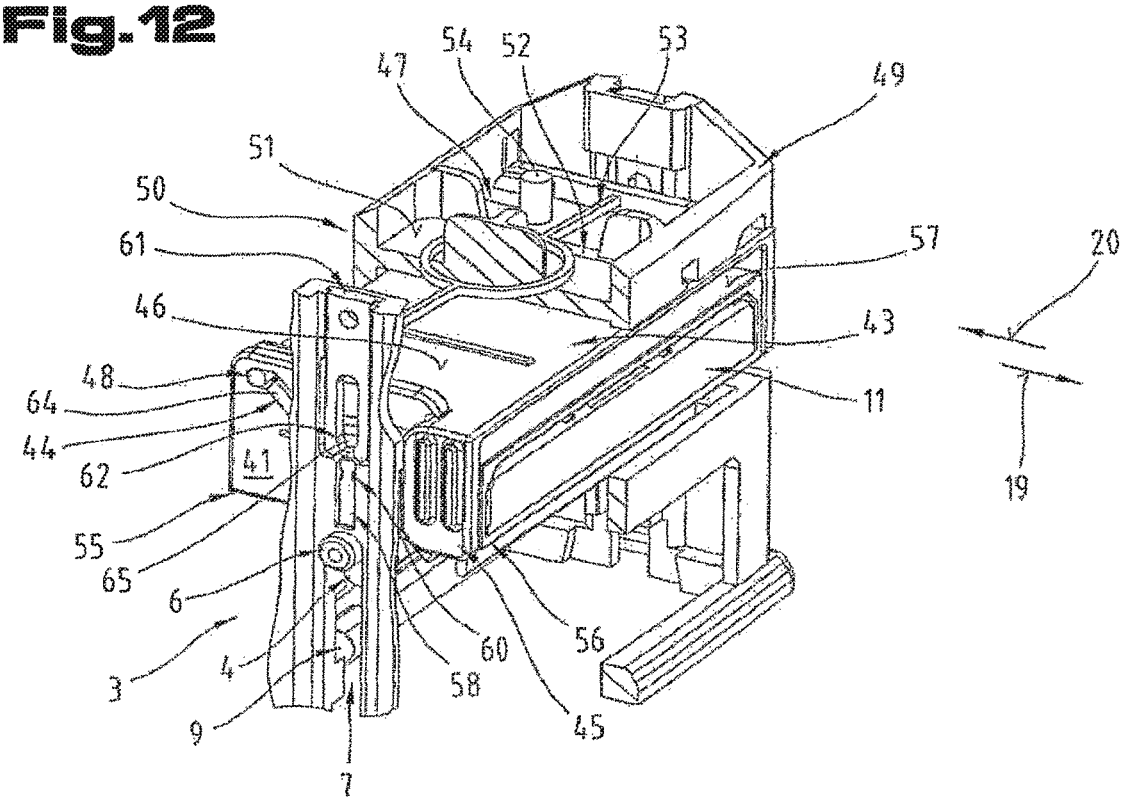
FIG. 12 the lower part of the stamp according to FIG. 11 with pad lifter and pusher shown perspectively and sectionalized.
Figure 13:
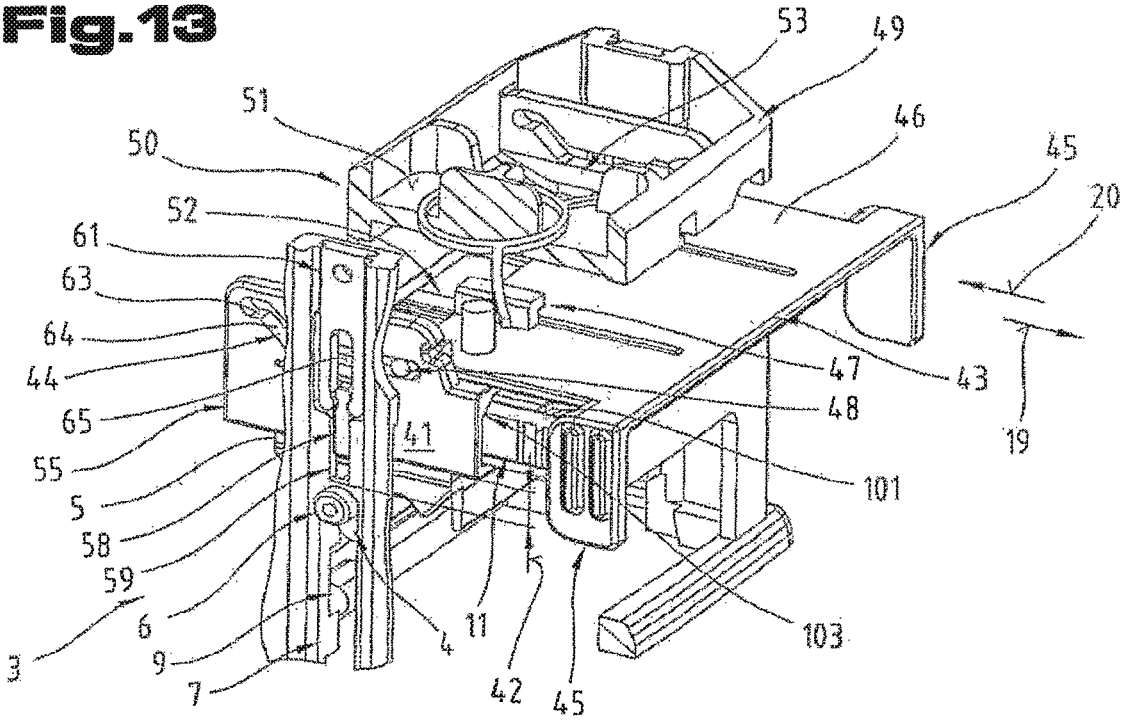
FIG. 13 the sectional representation of the lower part of the stamp according to FIG. 12 with the carrying device of the stamp pad in a position partly puled out of the lower part.

FIGS. 12 and 13 show details of the lower part 3 of the stamp 1 with the pad lifter 41 and the pusher 43 represented in section and in perspective. The representation according to FIG. 12 shows the carrying device 11 of the stamp pad 10 in its working position fully pushed into the lower part 3 of the stamp 1 while in the representation according to FIG. 13 the carrying device 11 is located in a position lifted off the stamp plate 5 of the printing plate carrier 4 by the vertical adjusting travel 42 and partially puled out of the lower part 3. The pusher 43 of the lifting mechanism substantially consists of a base plate 46, sliding bodies of a linear guide formed between the side 43 and the lower part 3 of the stamp 1 formed through guide profiles 47 and of driver pins 48 laterally standing away from the base plate which are in engagement with the link paths 44 of the stamp lifter 41. In hit upper end region the lower pan 3 of the stamp 1 comprises a front wall 49 and a rear wall 50 of the middle web 51 connecting the lower part 3. This is substantially formed plate-shaped and arranged in its vertical position in such a manner that it at least partially forms an upper limitation of the shaft 12 for the lifting mechanism or the carrying device 11. Lateral edges of the middle web 51 simultaneously form guideways 52 for the guide profiles 47 of the pusher 43. With the middle web 51 a leg spring 53 is connected which acts on the pusher 43, holding it back in the pushed-in position. To this end, support pins 54 are arranged on the base plate 46 of the pusher 43.

The pad lifter 41 is formed through two side walls 55 whose lower edges facing the printing plate carrier 4 are connected through a basic tame 56 bordering the stamp pad 10. In the region of the stamp lifter 41 facing the front wall 49 of the lower part 3 of the stamp 1 the two side wall 55 of the stamp lifter 41 are connected with each other through a web 57, which simultaneously forms the upper limit for the shaft-like receptacle 102 or guideway for the carrying device 11 of the stamp pad 10. The web 57 is arranged in such a manner or the side walls 55 of the pad lifter 41 are designed in such a manner that the side walls 55 protrude the web 57 upwards in vertical direction. In this protruding region of the side walls 55 the already described ink paths 44 are formed in the side walls 55. The base plate 46 of the pusher 43 substantially extends between these protruding regions of the side walls 55 of the stamp lifter 41. In the region of the base plate 46 fading the front wall 49 the handles 45 of the pusher 43 are arranged on a lateral expansion of the base plate 46, wherein the handles 45 laterally enclose the side walls 55 of the stamp lifter 41. The regions of the side walls 55 protruding the web 57 to this end are designed shorter in accordance with the lateral expansions of the base plate 46.

On the side walls 55 of the pad lifter 41 there is a sliding body 58 each which is guided in a guide slot 59 formed in the corresponding side wall of the lower part 3 of the stamp 1. The guide slots 59 each form a guide way of a linear guide which is orientated parallel to the vertical guide 7 for the axle pins 6 of the printing plate carrier 4. The siding body 58 according to this exemplary embodiment has the shape of an elongated cuboid and is displaceable in the guide groove 59 parallel to its longitudinal extension. In an end region facing away from the printing plate carrier 4 the siding body 58 comprises holding elements in form of laterally arranged engagement depressions 60. On the other side, a spring dip 61 with spring-plastic laterally adjustable catches 62 is arranged in each of the side walls of the lower part 3 of the stamp 1 in alignment with the guide groove 59. The spring clips 61 are positioned on and fastened to the lower part 3 in such a manner that in the position of the pad lifter 41 lifted off the printing plate carrier 4 the catches 62 of the spring dip 61 engage in the engagement depressions 60 of the sliding body 61 and the pad lifter 41 is thus held in this position.

The link path 44 formed in the side walls 55 of the pad lifter 41 comprises a first path section 63 that is located higher and orientated parallel to the pushing-out direction 19, a path section 64 running obliquely downwards and again a third path section 65 running parallel to the pushing-out direction 19. A movement of the driver pins 48 from the first path section 63 via the inclined second path section 64 into the third path section 65 that occurs when pulling out the pusher 43 thus brings about a displacement of the pad lifter 41 with the carrying device 11 of the stamp pad 10 upwards in vertical direction. Thus the carrying device 11 is lifted from the printing plate carrier 4 or the stamp plate 5 in vertical direction by the adjusting travel 42 and thus freed of the friction resistance acting between the stamp plate 5 and the stamp pad 10.

Figure 14:
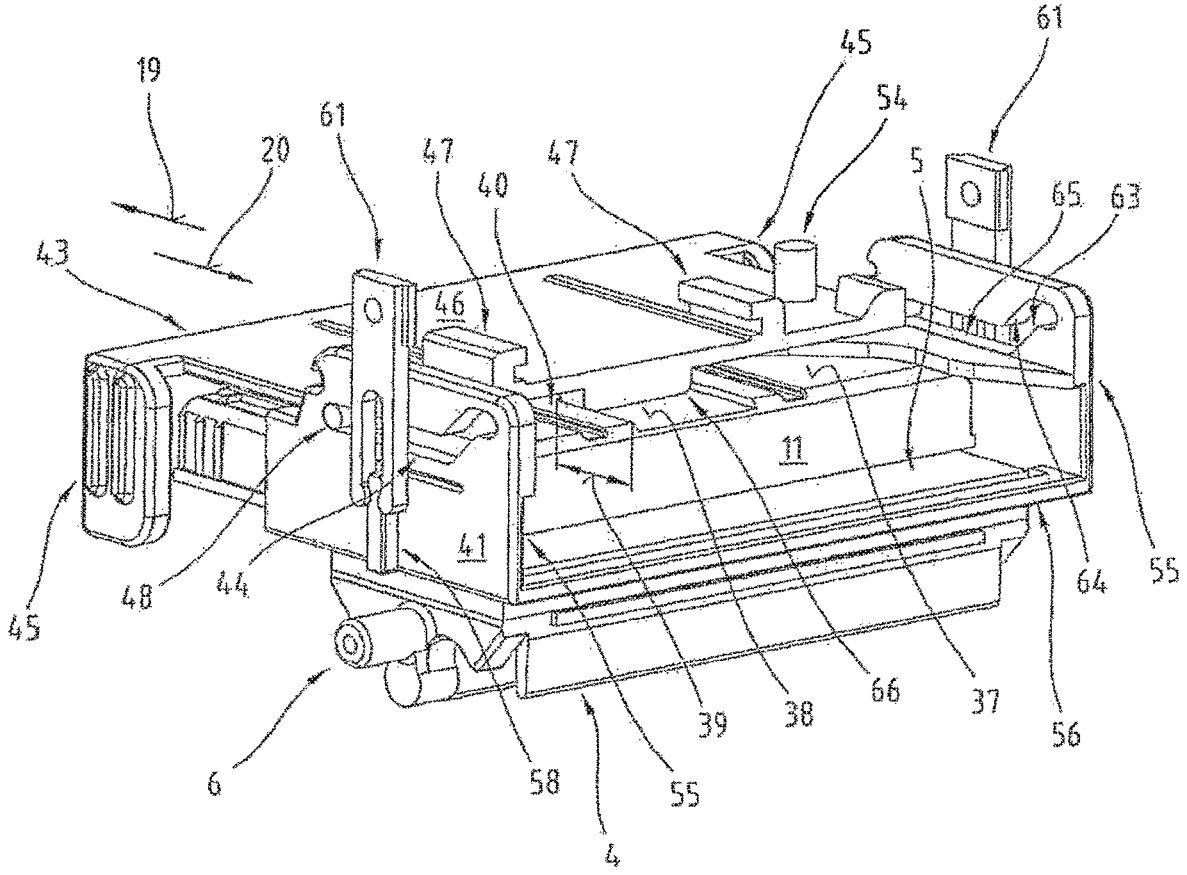
FIG. 14 a rearward view of the lifting mechanism in a position according to FIG. 13 shown perspectively.

FIG. 14 shows a rearward view of the lifting mechanism in a position according to FIG. 13 shown in perspective. As soon as the driver pins of the pusher 43 engaging in the link paths 44 have reached the lower path section 65 of the link path 44, the carrying device 11 of the stamp pad 10 is also puled out of the shaft 12 of the lower part 3 with progressing pushing-out movement of the pusher 43. To this end, a driver lug 66 protruding downwards is formed on the end region of its base plate 486 facing away from the handles 45 of the pusher 43. This driver lug 66 engages in a clearance 38 formed in the bottom 37 of the carrying device 11 until it has reached its stop 40. Having reached the maximum position of the pusher 43 pulled out of the lower part 3 it can be released and is again pulled back into the lower part 3 by the spring action of the leg spring 53. The carrying device 11 of the stamp pad 10 however remains in a position protruding the front wall 49 of the lower part 3 of the stamp 1 and can then be removed from the stamp 1. For inserting a new stamp pad 10 or a carrying device 11 the pad lifter 41 must be initially brought into a position lifted off the printing plate carrier 4, which is achieved in that the pusher 43 is at least pulled out of the shaft 12 so far that the driver pins 48 come to lie in the region between the oblique second path section 64 and the third path section 65 of the ink path 44. The carrying device 11 can then be entirely pushed into the shaft of the pad lifter 41, following which the pusher 43 is likewise pushed into the shaft 12 of the lower part 3. In the process, a displacement of the driver pins 48 of the pusher 43 via the oblique second path section 64 to the first path section 63 takes place, as a result of which the pad lifter 41 is displaced downwards and the stamp pod 10 of the carrying device 11 is pressed against the stamp plate 5.

Figure 15:
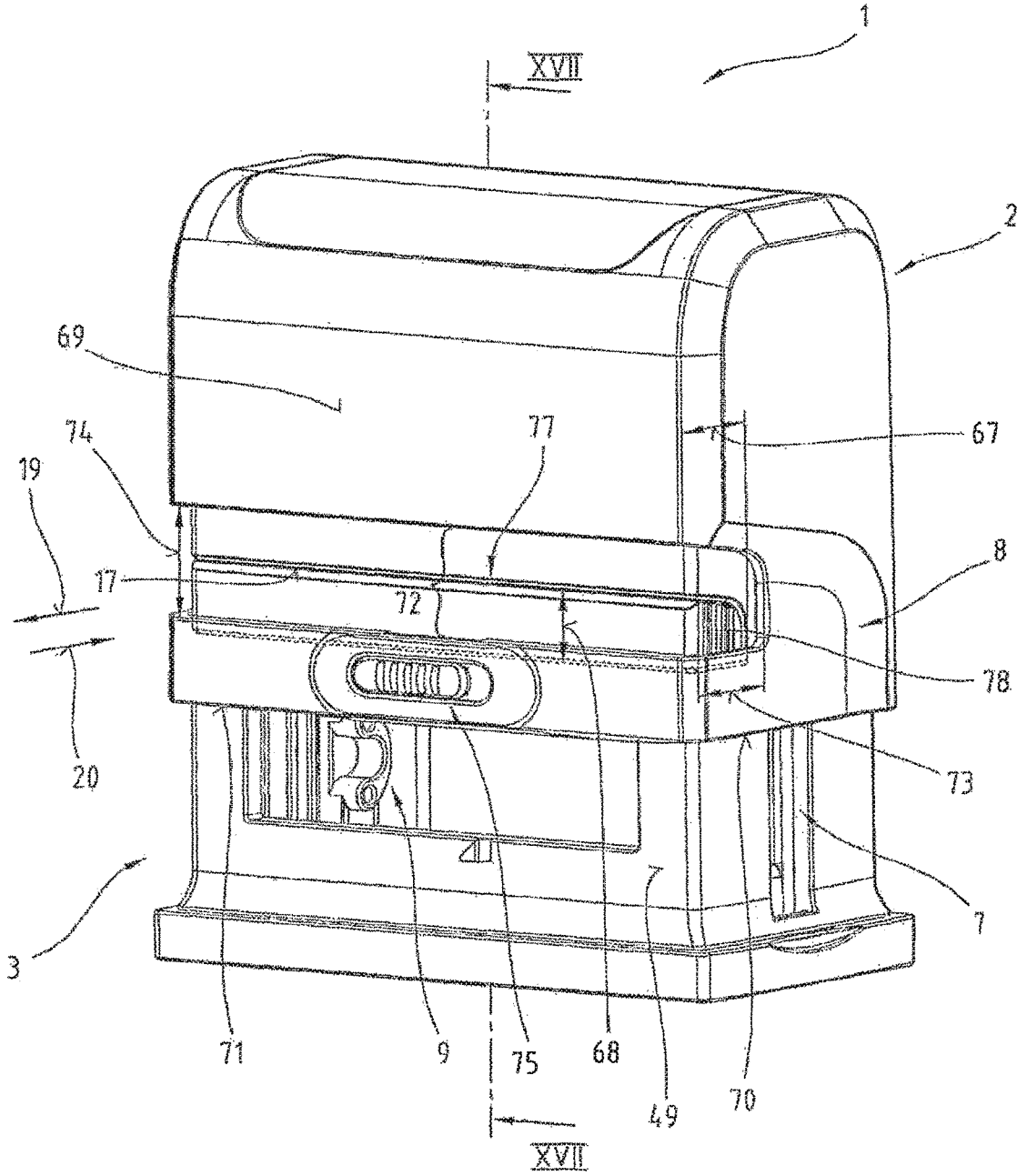
FIG. 15 a further exemplary embodiment of the stamp shown perspectively.

The following FIG. 15 to 20 show a further exemplary embodiment of a stamp 1 according to the invention. In FIG. 15 this stamp is shown in perspective. The lower part 3 substantially formed hollow prismatically with the reversing mechanism 9 for the printing plate carrier 4 (FIG. 17) carriers the upper part 2 of cap-like design or handle of the stamp 1 which is telescopically displaceable on the lower pan 3 against the resetting force of a spring (not shown) arranged between the upper part 2 and the lower part 3. The representation according to FIG. 15 corresponds to the starting position of the stamp 1, wherein the handle or upper part 2 is located in its starting position maximally displaced upwards. The opening 17 in the lower part 3, through which the carrying device 11 of the replaceable stamp pad 10 can be inserted or removed from the lower part 3 with this exemplary embodiment of the stamp 1 extends over the entire width of the front wall 49 of the lower part 3 as well as over a depth 67 in the side walls of the lower part 3 following the front wall 49 on both sides. In front view according to a viewing direction parallel to the pushing-in direction 20 the opening 17 appears with a rectangular shape and a height 88.

The side walls 8 of the cap-like handle or upper part 2 of the stamp 1 as well as a front wall 69 of the upper part 2 have a lower edge 70 or 71 which in the position according to FIG. 15 runs below the opening 17 in the lower part 3. Over the entire width of the front wall 69 of the upper part 2 a window 72 extends, which continues over a depth 73 in the two side wall 6. Like the opening 17 in the lower part 3, the window 72 in the upper part 2 has a rectangular shape in front view, that is with viewing direction parallel to the pushing-in direction 20, wherein a height 74 of the window 72 is at least equal to the height 68 of the opening 17. According to the basic position of the stamp 1 shown in FIG. 15, that is the position in which the upper part 2 or the handle of the stamp 1 is located in its position in which it is maximally displaced upwards relative to its lower part 2, the window 72 relative to the opening 17 in the lower part 3 is in a position which is located higher than the opening 17, so that the opening 17 is at least partially covered by the front wall 69 of the upper part 2. Thus, in the basic position of the stamp 1 shown, removing of the stamp pad 10 through the opening 17 is not possible. In order to be able to remove the stamp pad 10 it is required that the upper part 2 is displaced downwards relative to the lower part 3 so far that the window 72 is orientated relative to the opening 17 as shown in the following in FIG. 16 in order to be able to remove or reinsert the carrying device 11 with the stamp pad 10 from or into the lower part 3 of the stamp 1 without hindrance, a lock 72 or a bolt is provided on the upper part 2, which can be brought in engagement or fixed with a corresponding stop 76 (FIG. 17). The lock 75 or the stop 78 are preferentially arranged in the front wall 69 of the upper part 2 and on the front wall 49 of the lower part 3 respectively.

Figure 23A:
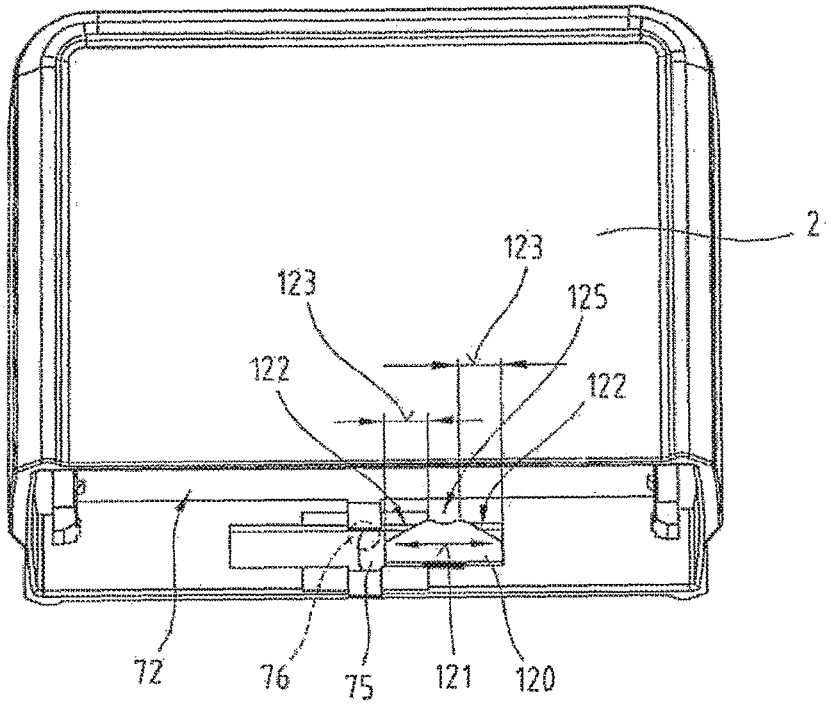
FIG. 23 a) and b) a further design of the stamp according to FIG. 15 with an alternative locking device.
Figure 23B:
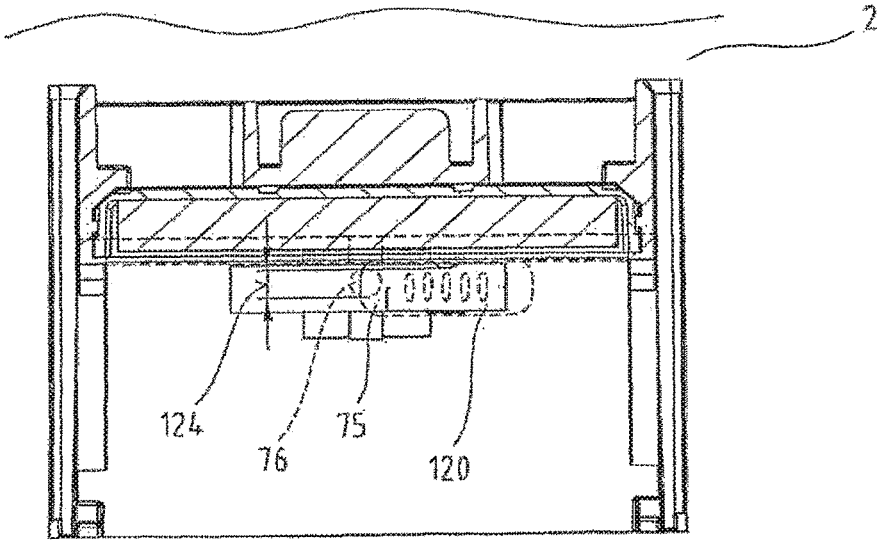
Figures 24, 25, 26, 27, 28:
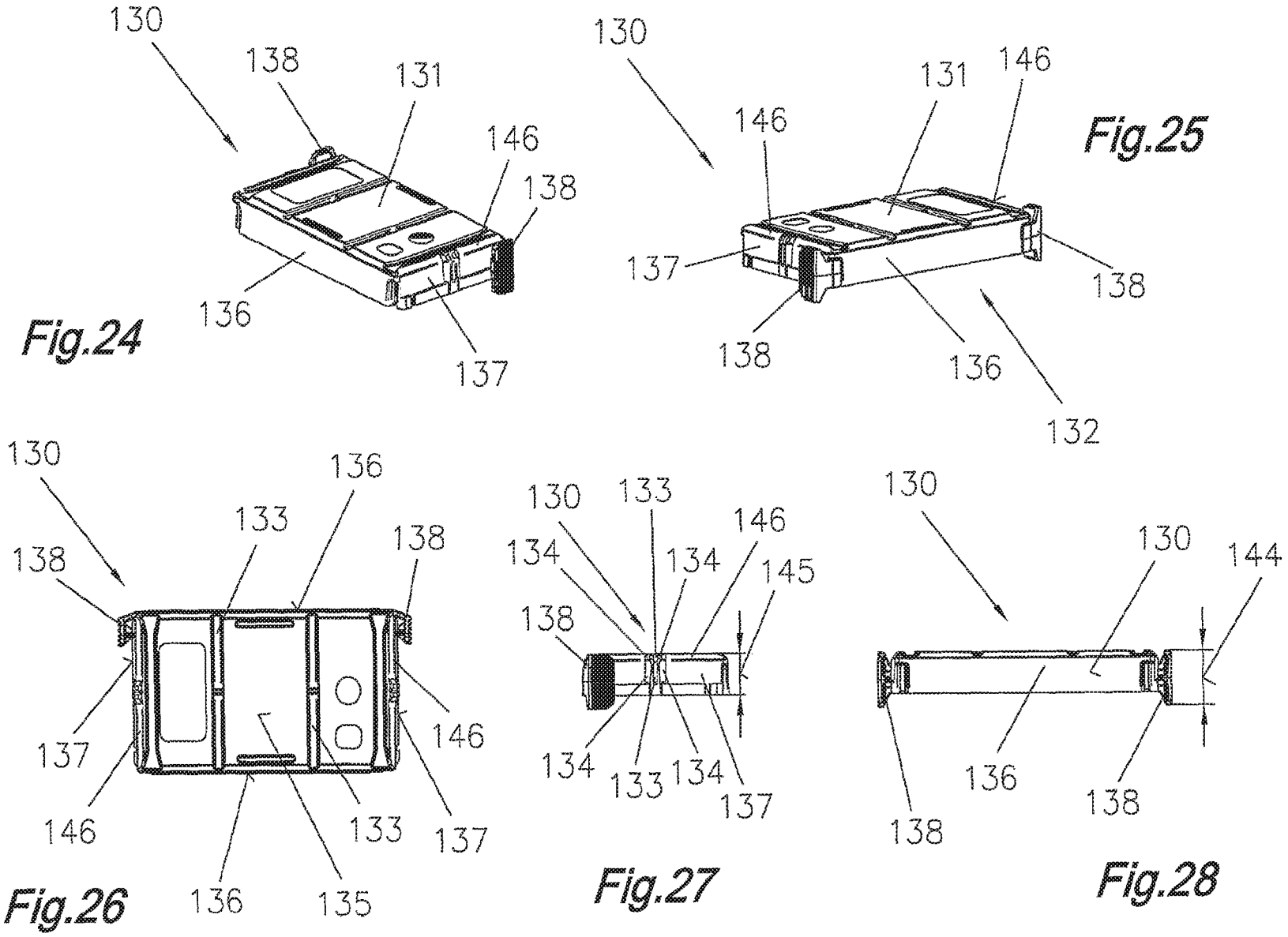
FIG. 24 is an exemplary embodiment of a stamp pad shown in simplified, schematic representation.
FIG. 25 is a further view of the stamp pad shown according to FIG. 24.
FIG. 26 shows a top view of the stamp pad according to FIGS. 24 and 25.
FIG. 27 is a lateral view of the stamp pad represented according to FIGS. 24 and 25.
FIG. 28 shows a front view of the stamp pad according to FIGS. 24 and 25.
Figure 30:
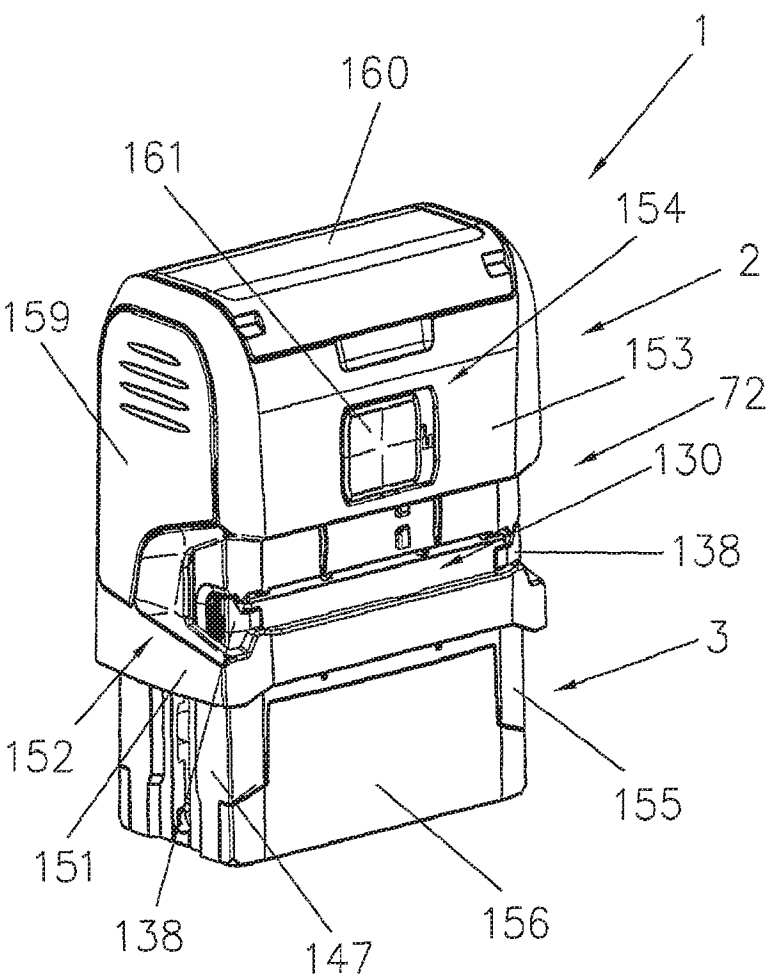
FIG. 30 shows a further view of the stamp according to FIG. 29.
Figure 29:
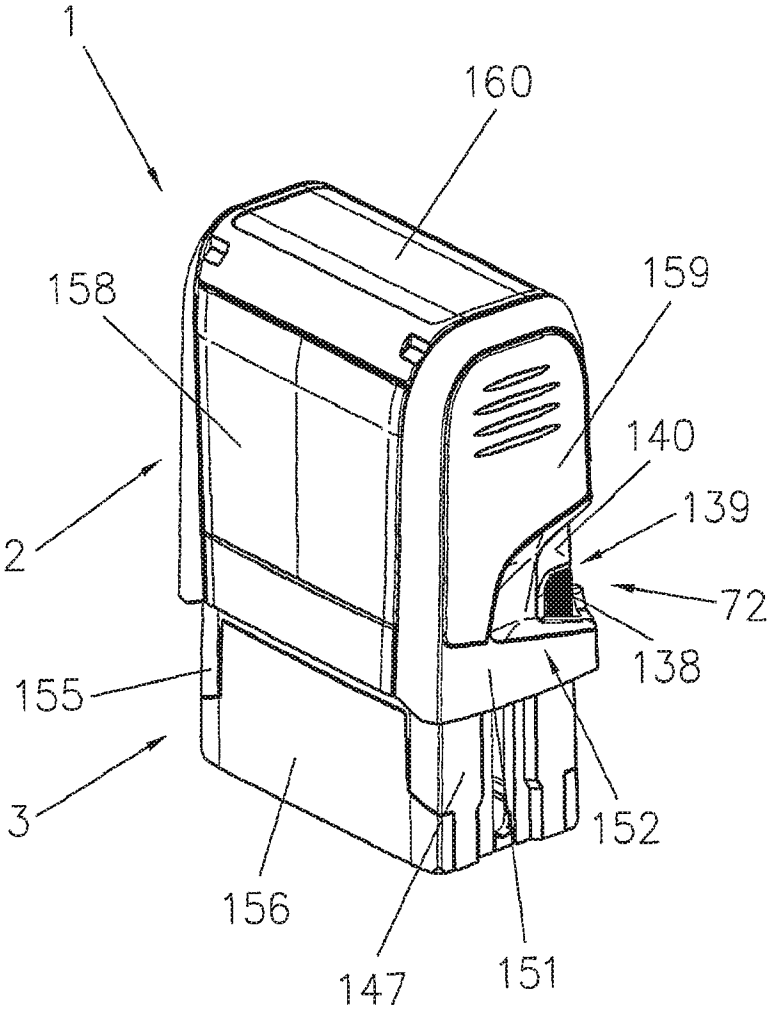
FIG. 29 shows a perspective representation of a stamp in rest position for a stamp pad according to FIG. 24 to 28.

For changing the pad the upper part 2 has to be aligned relative to the lower part 3 so that the window 72 of the upper part becomes congruent with the opening 17 of the lower part. Since for the sake of compact construction of the stamp 1 the height 74 of the window 72 is preferably only slightly greater than the height 68 of the opening 17, this orientation requires some manipulation effort under certain conditions, particularly for operators without practice who perform a pad change only very rarely. In a further development the bolt 76 can therefore have a guide profile 120 which slides along or down a corresponding stop 76 of the lower part 3 as is shown in FIG. 23. Thus it is possible through displacing 121 the bolt 75 and thus the guide profile 120 in the direction transversely to the movement direction of the upper part 2 to achieve a downward movement of the upper part. The dimension of the relative movement in this case corresponds exactly to the dimension by which the upper part 2 has to be displaced in order to render the opening 17 in the lower part 3 congruent with the window 72 in the upper part 2. The guide profile 120 of the lower part comprises at least one path section 122 which is inclined relative to the displacement direction 121 of the bolt 75, wherein the inclination of the path section is selected in such a manner that the displacement travel 123 of the bolt 75 is converted into a corresponding relative movement of the upper part 2 in order to move the upper part downwards through the window 72 by the spacing 124 for releasing the opening 17. The guide profile furthermore comprises an engagement position 125, in which the stop 76 of the lower part 3 can remain in the guide element 120 of the bolt 75 in a rest position and thus the lowered upper part 2 is also held in its position, as a result of which replacement of the carrying device 11 is possible in a simple manner.

For changing the carrying device the bolt 75 is displaced 121 laterally, as a result of which the stop 76 comes in contact with the rising path section 122 and thus the upper part 2 is moved downwards relative to the lower part 3. At the end of the travel 123 of the path section 122 the stop 76 reaches the engagement position 125 of the guide profile after crossing the apex point of the path section, as a result of which the position of the upper part is held relative to the lower part, more preferably the window 72 of the upper part now lies over the opening 17 of the lower part, as a result of which the carrying device can be removed. Having carried out the exchange the bolt is moved back into the starting position or moved further on in accordance with the previous movement direction, as a result of which the upper part is again moved upwards into its starting position since the stop 76 now slides down on a descending path section 122.

Figure 16:
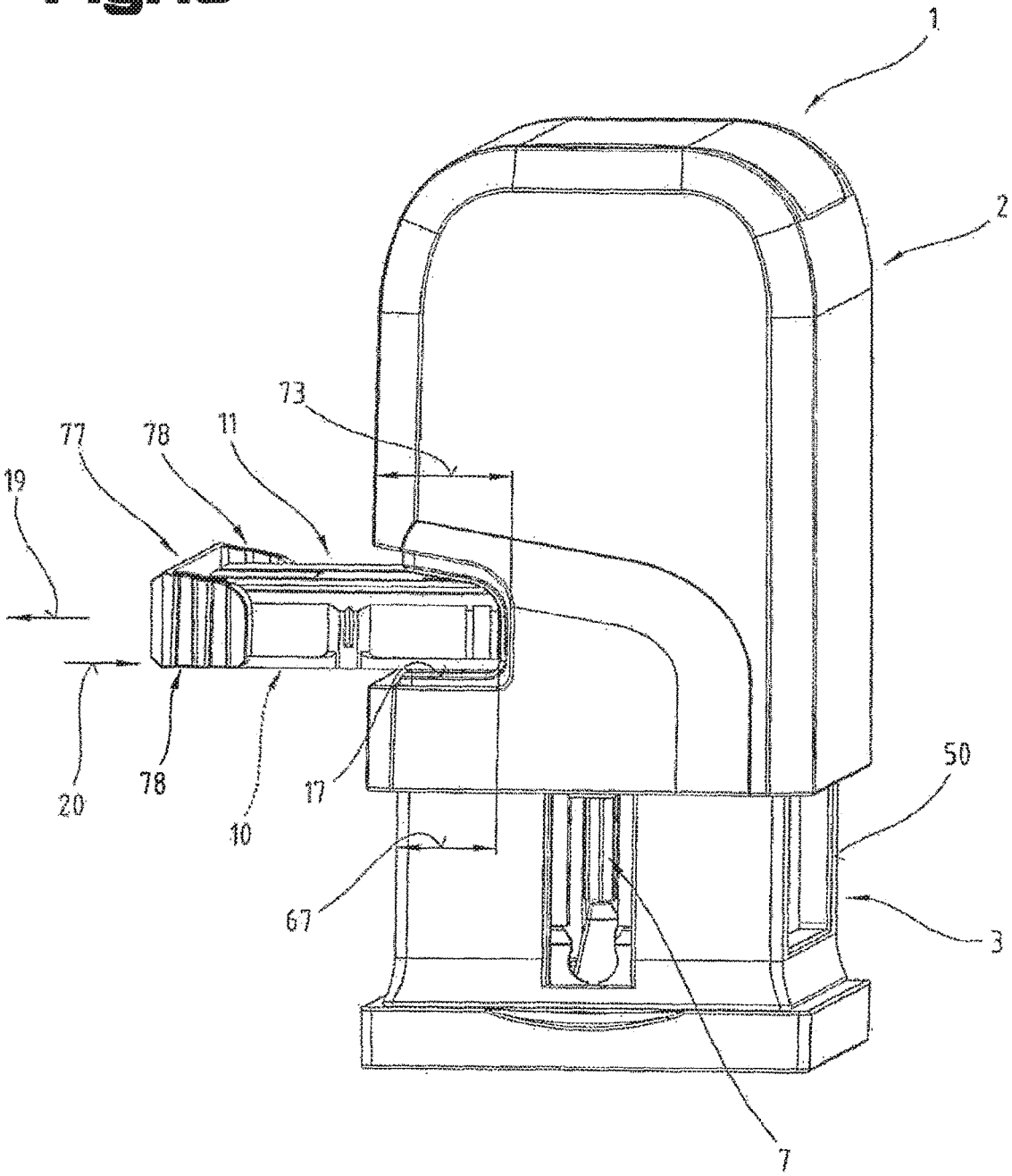
Figure 17:
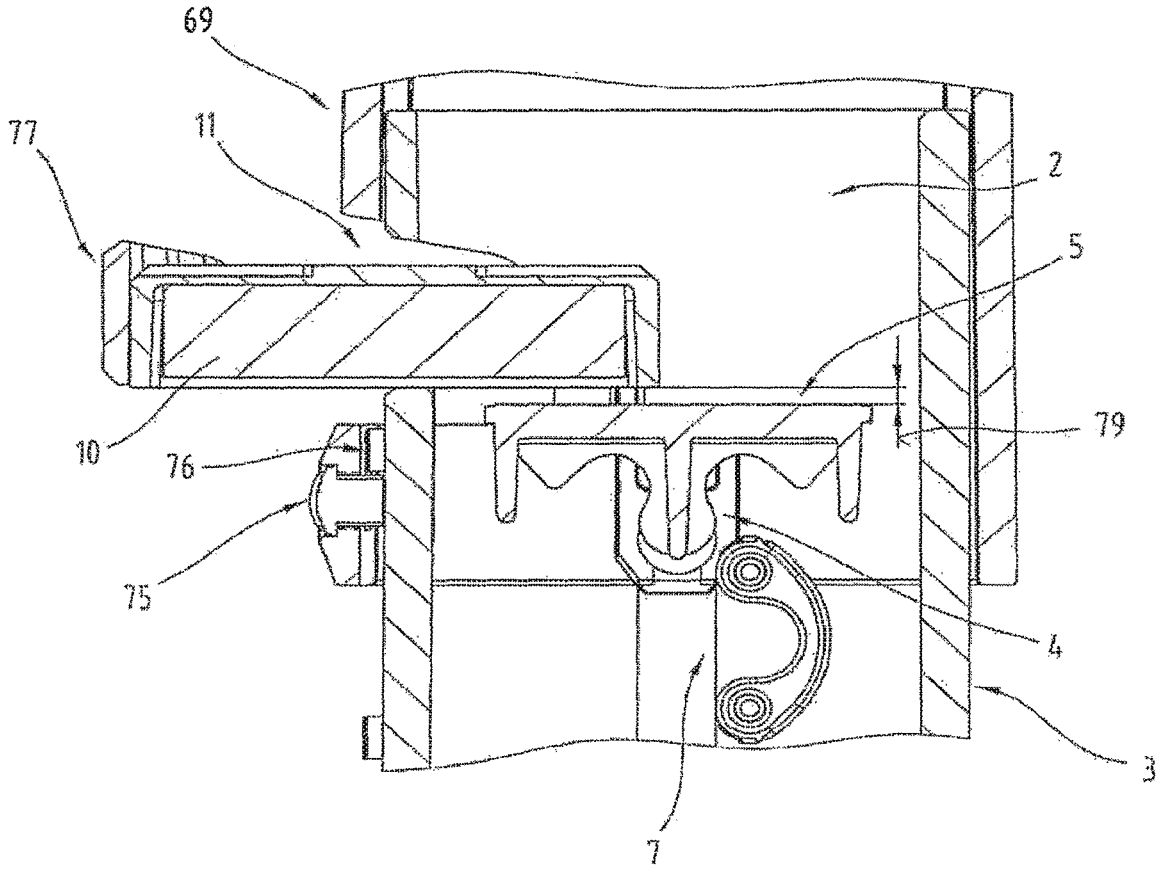
FIG. 17 a cross section of the stamp according to FIG. 10 shown sectionalized.

FIG. 16 shows the stamp 1 according to FIG. 15 with the stamp pad 10 or carrying device 11 partly pulled out of the lower part 3 in a perspective view. In FIG. 17 the stamp is shown in section in the position according to FIG. 16. As is more clearly evident from FIG. 16, a clamp 77 is fastened to the carrying device 11. The outer shape of the clamp 77 is substantially U-shaped and more preferably corresponds to the opening 17 in the lower part 3 with handles 78 arranged on the lateral end regions. Their extension parallel to the pushing-in direction 20 corresponds to the depth 67 of the opening 17 in the lower part 3. Facing sides of the two handles 78 of the clamp 77 are preferentially connected with the carrying device 11 through engagement connections on narrow sides of the carrying device 11. The shape of the clamp 77 is preferentially designed complementary to the opening 17 in the lower part 3. In the pushed-in position the opening 17 is thus completely closed by the clamp 77. On the other hand, providing the clamp 77 as soon as the window 72 of the upper part 2 is aligned with the opening 17 of the lower part 3 makes possible comfortable grasping and removing of the carrying device 11 with the stamp pad 10 from the stamp 1.

Since for aligning window 72 and opening 17 relative to each other a relative adjustment between the upper part 2 relative to the lower part 3 is initially required, which simultaneously because of the movement coupling between the upper part 2 and the printing plate carrier 4 via the axle pins 6 of the latter brings about lowering of the printing plate carrier 4 in the direction of the vertical guide 7, the stamp pad 10 is relieved of the pressing-on pressure of the stamp plate 5 otherwise acting in the basic position of the stamp 1 and these are lifted apart by a distance 79 (FIG. 17). The distance 79 substantially corresponds to the relative displacement which is required in order to align the window 72 in the upper part 2 relative to the opening 17 in the lower pert 3. The friction resistance between the stamp plate 5 and the stamp pad 10 acting in the starting position (FIG. 15) is thus canceled and the carrying device 11 with the stamp pad 10 can be removed or reinserted with correspondingly little expenditure of force.

Figure 18:
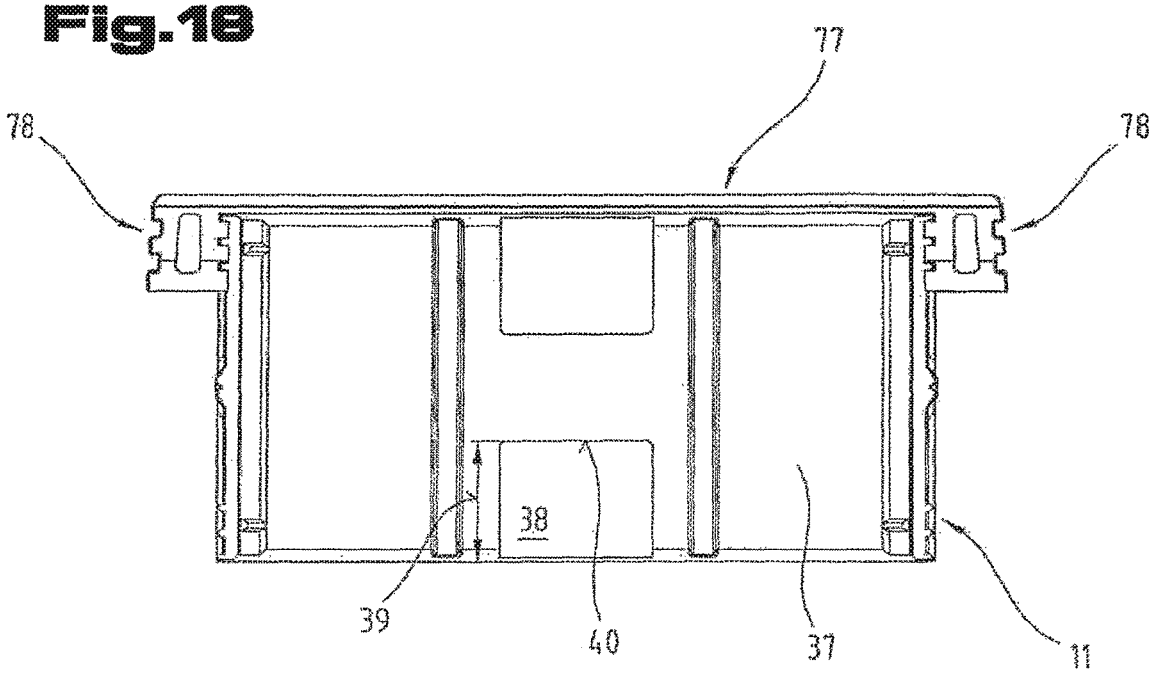
FIG. 18 a top view of the carrying device of the stamp with the clamp, for the stamp according to FIG. 16.
Figure 19:
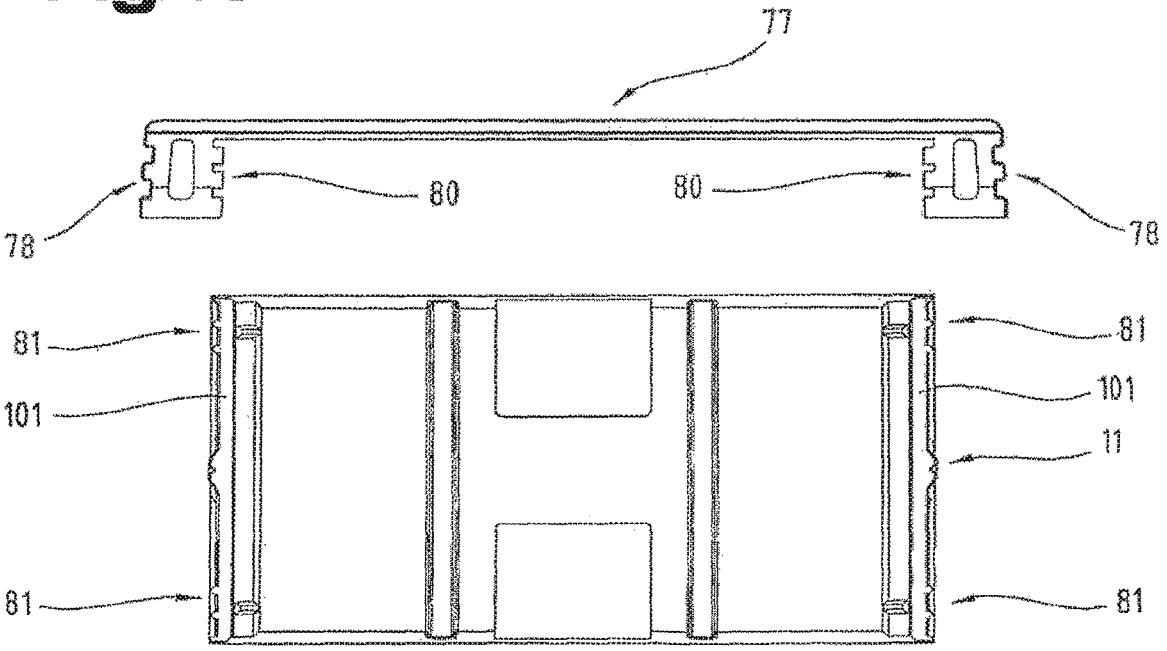
FIG. 19 the carrying device and the clamp according to FIG. 18 shown in positions separated from each other.

FIG. 18 shows the carrying device 11 of the stamp pad 10 with the clamp 77 according to FIG. 16 in top view. In FIG. 19 the carrying device 11 and the clamp 77 are shown in positions separated from each other. The sides of the two handles 78 of the clamp 77 facing each other are provided with a rack-like tooth profile 80. Accordingly, tooth profiles 81 complementary to the tooth profiles 80 of the clamp 77 are formed in the regions of the shorter narrow sides adjacent to the long narrow sides of the carrying device 11. The tooth profiles 80, 81 are preferentially formed with flanks orientated perpendicularly to the bottom 37 of the carrying device 11. Accordingly, the tooth profiles 80 of the clamp 77 can be displaced relative to each other in a direction perpendicular to the bottom 37 relative to the tooth profiles 81 of the carrying device 11. Fastening the clamp 77 to the carrying device 11 is thus affected in that the two tooth profiles 80 are run up to the ends of the tooth profiles 81 corresponding to the bottom 37 of the carrying device 11 and the tooth profiles 80 of the clamp 77 are pushed into the tooth profiles 81 of the carrying device 11. For exchanging the stamp pad 10 or the carrying device 11 it is puled out of the lower part 3 of the stamp as shown in FIG. 16 in the direction of the pushing-out direction 19 with the help of the camp 77. After this, the clamp 77 is released from the carrying device 11 and joined with a new carrying device 11 which is then inserted in the lower part 3 of the stamp 1 in accordance with the pushing-in direction 20 with the help of the clamp 77, until clamp 77 closes or bears on the opening 17. FIG. 19 furthermore shows the edge designed as chamfer 101 between the bottom 37 and the short narrow side of the carrying device 11. This chamfer can for example serve to prevent faulty insertion, since the carrying device can only be inserted in the receiving device or in the drawer correctly aligned, that is with the correct orientation of the stamp pad with respect to the stamp plate. 8*y* coding the chamfer, that is for example through different chamfer angles or chamfer widths, a carrying device can be formed that can be specifically configured for different stamp versions. Preferably both chamfers will have the same basic geometry, additional codings are formed for example in that the chamfer has a greater width and/or a larger inclination angle so that the carrying device can always be inserted in a stamp with the basic complementary profile as well, as long as the stamp pad is compatible. However, the chamfer also has the advantage that the carrying device can be inserted in a stamp whose receiving device or drawer has no such mating chamfer since the material part absent through the chamfer does not appear disruptive.

Figure 20:
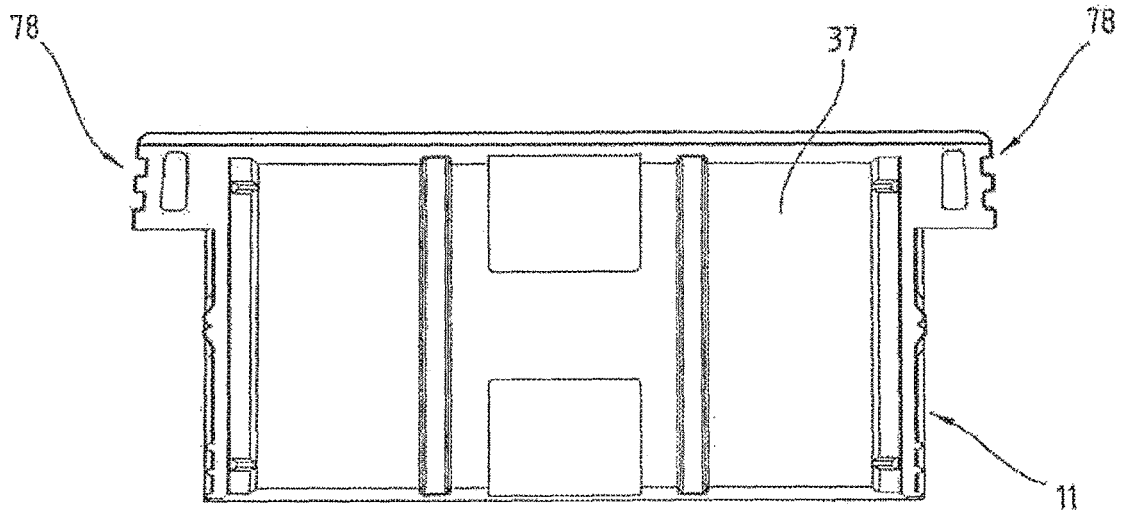
FIG. 20 an alternative exemplary embodiment of a carrying device for a stamp pad for the stamp according to FIG. 15.

FIG. 20 shows an alternative exemplary embodiment of a carrying device 11 of a stamp pad 10 for the stamp 1 according to FIG. 15. With this carrying device 11—adjacent to one of the long narrow sides—the handles 78 are formed unitarily with the carrying device 11 on the two short narrow sides. The carrying device 11 according to this exemplary embodiment appears T-shaped in a top view directed perpendicularly with respect to the bottom 37. The handles 78 laterally standing away in such a manner allow comfortable and secure gripping of the carrying device 11 through the window 72 of the handle or upper pert 2. With this design the entire carrying device 11 is replaced when replacing a pad, including the handle pieces 78 that are present to facilitate grasping.

FIG. 21 a to c show a further exemplary embodiment of a carrying device 11 for a stamp pad 10 according to FIG. 18. The clamp 77 from FIG. 18 now additionally comprises a cover 84, which is connected with the clamp via a web-like connecting means and which, in the state fitted to the carrying device 11, completely covers the stamp pad 10. Through this coverage a reliable contact protection and thus protection from contamination is guaranteed, furthermore this cover 84 can tightly seal the carrying device in such a manner that a transport package is created which prevents drying-out of the stamp pad prior to the actual use. To this end, a sealing means can be attached to the border of the cover 84 facing the stamp pad 10. The clamp 77 with the cover 84 is fitted on to the carrying device 11 in a fitting direction 88 during manufacture, wherein the clamp 77, more preferably the handles 78 with the moulded-on tooth profiles 80, are pushed into corresponding complementary tooth profiles 81 of the carrying device 11. Since the web connecting the handles 78 is omitted with this further development, additional guide profiles are arranged on the long narrow side of the carrying device 11 adjacent to the short narrow side of the handles, wherein a guide profile 86 of the clamp engages in a corresponding mirror-inverted guide profile 87 of the carrying device 11 thus fixing the clamp 77 and consequently the cover 84 on the carrying device 11. In a further development the tooth profiles 80 of the handles 78 can be omitted since the guide profile 88, 87 offers adequate mechanical stability and fixing of the handles 78 on the carrying device.

Before inserting the carrying device 11 in the stamp 1 according to FIG. 15 the cover is lifted by the long narrow side located opposite the handles 78 until the cover breaks off the clamp 77 along the connecting means designed as predetermined breaking point 85 making the stamp pad 10 freely accessible. The web-like connecting means however can also be designed through a constriction for example in form of a film hinge, as a result of which the cover can be separated from the clamp through tearing off or cutting off if applicable. The carrying device is then inserted in the stamp 1, as was described previously with FIG. 15. FIG. 21*b* shows a detail region of the clamp 77 in this regard. The cover 84 is connected with the handle 78 via a web-like connecting means, which on lifting off the cover 84, breaks or is severed as described and thus makes possible severing the cover from the handles 78. The handles 78 remain connected with the carrying device 11 through the guidance in the tooth profiles 80, 81 or in the guide profile 86, 87 and thus allow comfortable insertion in the stamp 1.

Figure 21A:
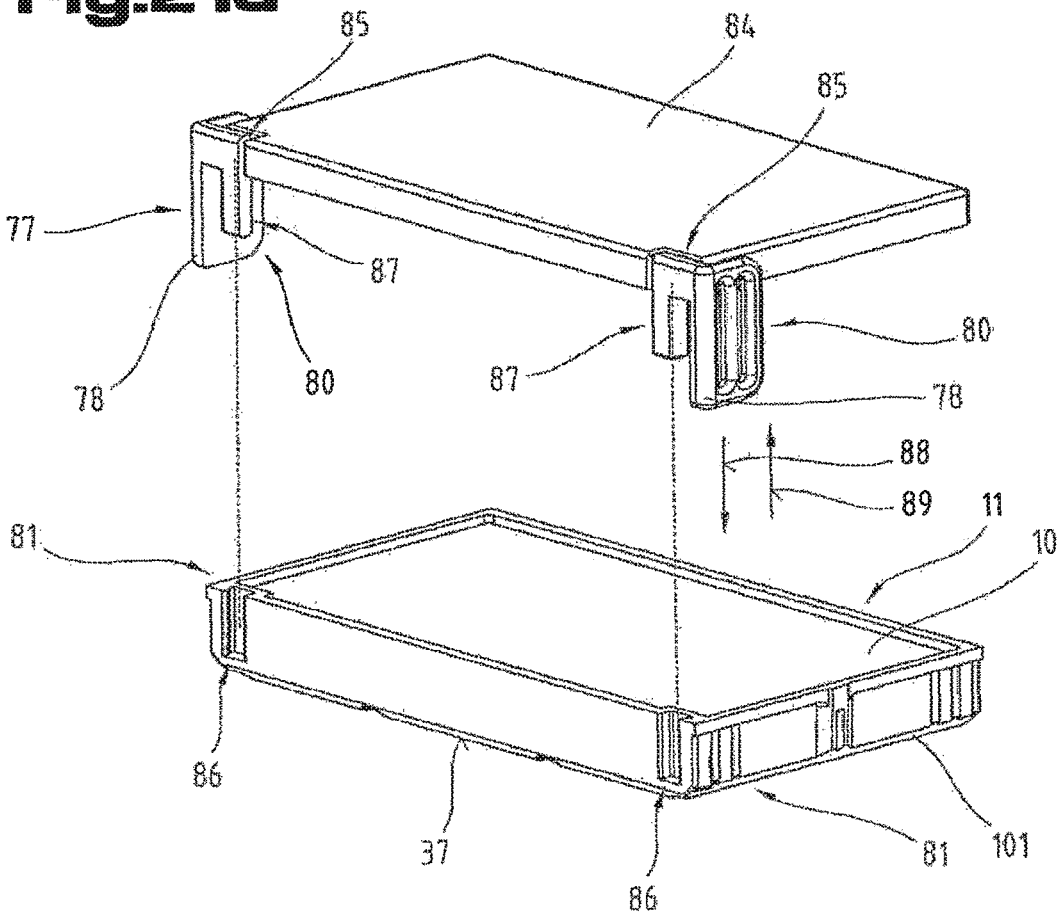
FIG. 21 a) and b) a further alternative design of a carrying device for a stamp pad for the stamp according to FIG. 1 and FIG. 15.
Figure 21B:
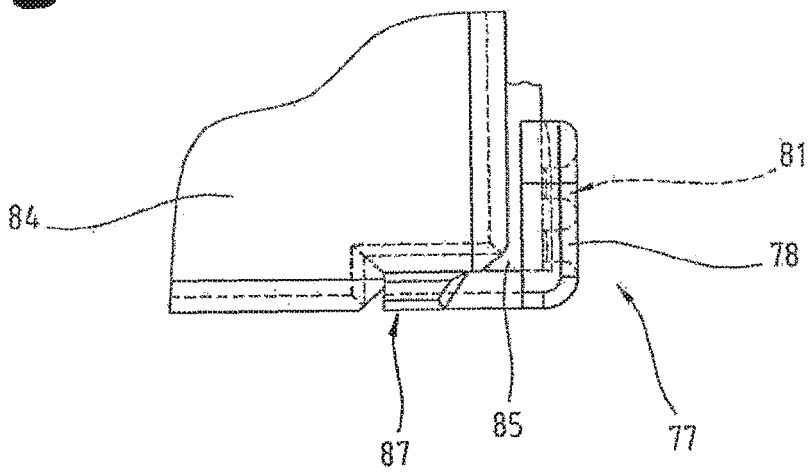

For a stamp 1, wherein the carrying device 11 is inserted in a drawer 13, or a stamp 1 according to a design shown in FIG. 1 to 15, the further-developed carrying device 11 can likewise be inserted, since the clamp 77 can be completely pulled off the carrying device in that the clamp is pulled off 89 perpendicularly to the bottom 37 of the carrying device relative to the tooth profiles 80, 81 or guide profiles 86, 87, as is show in FIG. 21*a*. The remaining carrying device 11 can thus be inserted in the drawer 13 as described before. With this further development a universal carrying device 11 is created which in an advantageous manner can be employed for stamps 1 of different design, wherein the carrying device can be adapted to the requirements of the respective stamps through very simple manipulation steps. In combination with a chamfer 101 provided if applicable, the carrying device can also be configured specifically to different stamp types. It is of particular importance however that only one basic type of a carrying device can be used for a plurality of different stamp types, which in terms of manufacturing and especially in the field of replacement parts logistics brings with it quite a decisive cost advantage.

Figure 22:
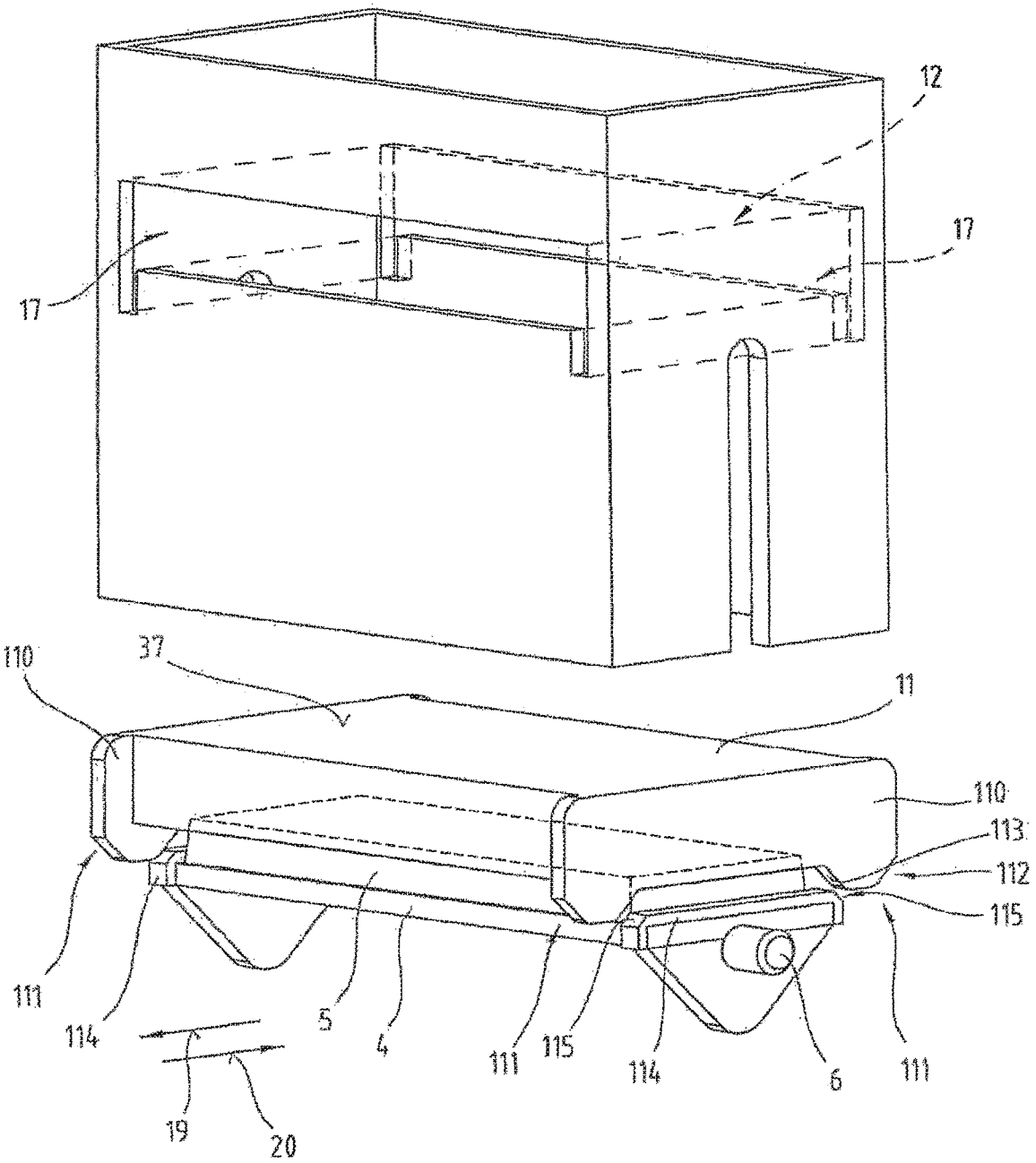
FIG. 22 an alternative exemplary embodiment of a carrying device for a stamp pad for the stamp according to FIG. 15.

When changing the stamp pad with a stamp 1 according to FIG. 15, the printing plate carrier 4 with the stamp plate 5 is removed from the carrying device 11 by the spacing that is sufficient to unload the stamp plate 5 so far and lift it off the stamp pad 10 that the carrying device can be removed from the shaft 12 subject to the avoidance of a friction resistance as far as possible through a downward movement of the upper part 2 parallel to the vertical guide 7. FIG. 22 now shows a further possible design in order to lower the printing plate carrier 4 and thus the stamp plate 5 during the removal or insertion of the carrying device 11 so far that unhindered pushing in or pushing out of the carrying device 11 is possible without having to bring the upper part 2 into a pad changing position through pressing down. The opening 17 in the front wall 49 thus is also accessible when the upper part 2 is in the rest position and the stamp plate 5 contacts the stamp pad 10. The carrying device 11 of this further development now comprises a guide profile 110 on each of its face-end narrow sides orientated parallel thereto, wherein the guide profile additionally comprises one but preferably two ramps 111. These guide profiles thus also constitute a means for reducing the pressing-on pressure and for eliminating the contact between the stamp plate and the stamp pad. The ramps 111 are arranged on the face ends of the guide profile 111 and protrude the flat side located opposite the bottom 37 of the carrying device 11. Furthermore, the ramps each comprise a first 112 and second 113 ramp section whose slope for example corresponds to that of a ramp 115 of a guide profile 114 of a printing plate carrier. When removing the carrying device according to the pushing-out direction 19 the carrying device 11 is displaced relative to the printing plate carrier 4, wherein the first ramp section 112 of the Guide profile 110 of the carrying device 11 slides down on the ramp 115 of the guide profile 114 of the printing plate carrier 4 resulting in a movement of the printing plate carrier parallel to the vertical guide 7, more preferably the stamp plate 5 is thus moved away from the stamp pad 10 so that the carrying device 11 can be substantially puled out of the shalt 12 without any friction resistance worth mentioning. Upon insertion the conditions are exactly reversed. The second 113 ramp section of the carrying device 11 will come in contact with the ramp 115 of the printing plate carrier 4 and slide down on the letter, again resulting in a relative downward movement of the printing plate carrier parallel to the vertical guide 7 and the carrying device can thus be pushed in. When the carrying device 11 has reached the working position, the ramp 115 of the printing plate carrier 4 slides down on the first ramp section 112 of the carrying device 11 and the printing plate carrier 4 and thus also the stamp plate 5 are moved towards the carrying device and the stamp plate pressed against the stamp pad 10 with a predetermined pressure.

To facilitate sliding-in the second ramp section 113 of the guide profile 110 of the carrying device 11 can have a minor inclination. In contrast with this, preferably fast separation of stamp plate 5 and stamp pad 10 is desirable during pushing out so that a minor displacement of the carrying device 11 in pushing-out direction 20 is sufficient for separating stamp plate and stamp pad, as a result of which the first ramp section 112 will have a preferably large inclination.

To simplify the pad change the rear wall 50 of the lower part 3 also comprises an opening 17 in a further development, wherein the two openings 17 of identical shape are located opposite each other in the front and rear walls and thus form a continuous shaft 12. This design more preferably has the advantage that a pad change can be performed from both sides of the stamp 1. For example by inserting a new carrying device the inserted carrying device can be pushed out without additional manipulation operations being necessary for this purpose. In the pushed-in position the carrying device is held in position through the operationally connected or engaged orientation of the guide profiles of the carrying device and the printing plate, which more preferably prevents displacement of the carrying device due to the back pressure through the ramps 113, 115 aligned with each other.

The exemplary embodiments show possible embodiment versions of the stamp 1, wherein it must be mentioned at this point that the invention is not restricted to the specifically shown embodiment version of said invention, but rather that diverse combinations of the individual embodiment versions are possible and this variation possibility because of the teaching to technical action through the concrete invention is within the capability of the person skilled in the art of this technical area in other words, all conceivable embodiment versions that are possible by combining individual details of the embodiment version shown and described are included in the scope of protection.

FIG. 24 to 35 describes and shows a further exemplary embodiment for a solution according to the invention, wherein the carrying device 11 is directly realised through a stamp pad 130, i.e. the stamp pad 130 is directly designed as carrying device 11 and directly inserted in the shaft 12 of the shaft 1 without additional tools, as a result of which an additional element, in particular the drawer 13, as shown in the previously described exemplary embodiments, can be omitted. Obviously it is also possible that this design of the solution according to the invention can be realised by way of a drawer 13 in which the stamp pad 130 is inserted, as is described in FIGS. 1 to 23.

In FIG. 24 to 28 the stamp pad 130, which forms the carrying device 11, is schematically shown, wherein the stamp pad 130 is designed for a self-inking stamp 1 and at least one pad 132 for picking up ink is arranged in a housing 131 or in the carrying device 11, and on the carrying device 11 means in form of grooves 133 and/or elevations 134 for the fixing in the stamp 1 are preferably arranged. The stamp pad 130 is formed from the preferably rectangular housing 131 which is formed of a base plate 135, two longitudinal surfaces 136 and two lateral surfaces 137, so that via the non-continuous surface of the housing 131 the pad 132 can be inserted as indicated by an arrow, contacts the printing plate of stamp plate 5 for picking up ink in the rest position of the stamp 1 with the stamp pad 130 inserted. For fixing the pad 132 protrusions, engagement elements of the like are arranged within the housing 131.

The dimensioning of the stamp pad 130 is preferably designed in such a manner that these can be used in self-inking stamps 1 of the same design which are already included in the prior art, as for example described in the introduction of the description. With the solution according to the invention the stamp pad 130 is designed for a self-inking stamp 1, which will be described in more detail in the following, wherein on the lateral surfaces 137 of the carrying device 11 a handle element 138 each for the lateral holding and puling out of the carrying device 11 or the stamp pad 130 from a stamp 1 formed of a plurality of parts displaceable within one another is arranged, wherein the handle elements 138 are designed for insertion in a clearance 139 of a lower part 3 of the stamp 1 and these do not protrude the outer surface 140 of the lower part 3, so that an upper part 2 of the stamp 1 can be displaced via the clearance 139 with the handle elements 138 inserted in the lower part 3.

Preferably the handle elements 138 are fixed on the lateral surfaces 137 via a fastening means 141, wherein for this purpose for example on the lateral surfaces 137 at least one groove 142 is arranged and corresponding there to, at least one protrusion 143 on the handle element 138. The grooves 142 on the lateral surfaces 137 are preferably blocked in one direction so that the protrusions 143 of the handle element 138 are only pushed in a certain direction and only as far as to the blockage in the grooves 142, as is evident in FIG. 35. Here, the handle element 138 can extend over the corner region, wherein preferably at least one fastening means 141 is arranged on the longitudinal and lateral surfaces 136 and 137, so that secure and firm hold of the handle element 138 on the carrying device 11, more preferably the housing 131, is achieved. In the case of symmetrical configuration of the stamp pad 130 it is possible to fasten the handle elements 138 in each corner region, wherein for use in a stamp 1 the handle elements 138 are arranged in the corner regions of the same longitudinal surface 136. If there are signs of wear, the user can attach the handle elements 138 on the opposite grooves 142 however and thus insert the stamp pad 130 rotated by 180°.

The handle elements 138 are designed in such a manner that they protrude the carrying device 11 or the housing 131 on the lateral surfaces 137 and on the front, more preferably the longitudinal surface 136, end flush with the latter. Corresponding to this, clearances 139 are required in the lower part 3 of the stamp 1, as will be described in more detail in the following. The protruding handle elements 138 and the lower part 3, more preferably the clearance 139 in the lower part 3, are matched to one another in such a manner that with inserted stamp pad 130 the outer surfaces 140 on the lower part 3 of the stamp 1 end approximately flush with the front of the carrying device 11 and the handle elements 138, so that during a stamping operation the upper part 2, as known from the prior art, can be pushed over the lower part 3.

For improved removal of the carrying device 11 or the stamp pad 130 notches, protrusions, grooves or the like are arranged on the handle elements 138, more preferably on their surface, to prevent slipping off when pulled from the stamp 1. It is also possible that a width 144 of the handle elements 138 protrudes a width 145 of the lateral surface 137 or the housing 131 of the carrying device 11 so that a larger handling area is crested for the user.

Through the arrangement of removable handle elements it is achieved that when using the stamp pad 131 in other older types of a self-inking stamp 1 these can be removed and the stamp pad thus inserted, as a result of which downward compatibility is advantageously achieved. Obviously it is also possible that only one handle element 138 is arranged, which extends from a lateral surface 137 over a longitudinal surface 136 to the additional lateral surface 137 orientated in parallel, so that in turn lateral gripping of the stamp pad 131 with two fingers is possible. The carrying device 11 can also be designed as one part with the handle element 138, that is as one-part injection moulded component, wherein such a design does not have any downward compatibility and the handle elements 138 are not removable.

Substantial with the design having laterally arranged handle elements 138 is that these in the inserted state do not protrude the outer surface 140 of the lower part 3, so that sliding into each other of the lower and upper parts 3 and 2, that is a stamping operation, is possible.

In addition to this, means, known from the prior art, in form of grooves 133 and/or elevations 134 are arranged on the lateral surface 137 of the carrying device 11 for fixing in a stamp 1. This arrangement on the lateral surfaces 137 allows fixing the stamp pad 130 in older self-inking stamps 1 that form part of the prior art, as a result of which a downward compatibility is present. Disadvantageous with such a fastening system arranged on the lateral surfaces 137 is that the stamp pad 130 is only fixed in a horizontal plane. To achieve better fixing of the stamp pad 130 in the stamp 1 a surface 146 running at an angle is arranged over at least a pert region of a lateral surface 137 of the carrying device 11, on which a means for fixing in a stamp 1 is positioned. The means in turn is formed through grooves 133 and/or elevations 134 as they are also used in the lateral surfaces 137. Through the angular arrangement it is achieved that a horizontal and vertical force is simultaneously exerted via the protrusion or elevations 134 protruding into the grooves 133. Thus the stamp pad 130 when contacting a printing plate or the stamp plate 5 can no longer be displaced in vertical and horizontal directions. The angle of surface 146 preferably amounts to 45° to the base surface.

It can thus be said that the difference to the stamp pad 130 for self-inking stamps 1 known from the prior art is that the handle elements 138 are arranged on the lateral surfaces 137 and the means for fastening the stamp pad 130 in the stamp 1 now utilize a surface 148 running at an angle, as a result of which pressure generation in horizontal and vertical direction on the housing 131 of the stamp pad 130 is achieved.

In order to be able to insert such a stamp pad 130 it is necessary to suitably design the stamp 1 to accommodate the stamp pad 130 as shown in FIG. 29 to 36, wherein only the most substantial parts and differences are described. The stamp 1 is equipped with a hinged printing plate carrier 4 with a stamp plate 5 and with a receiving device in form of a shaft 12 for a replaceable carrying device 11 or a stamp pad 130. The printing plate carrier 4 and the receiving device are arranged in the lower part 3, wherein the printing plate carrier 4 is adjustable in vertical direction from a starting position—FIG. 29—in which it contacts the stamp pad 130 with a pressing-on pressure—into a position for generating a stamp imprint (stamping position, not shown), wherein in the stamping position the stamp plate 5 is pressed against a contact surface and thus generates an imprint of the stamp plate 5. The receiving device is at least formed through a shaft 12 running transversely to the vertical direction in which the stamp pad 130 or the carrying device 11 is inserted. Here it is possible that suitable guide webs, notches etc. can be arranged.

In order for the previously described stamp pad 130 to be useable it is necessary that the lower part 3 is designed for receiving and fixing the stamp pad 130. To this end, a surface 148 running at an angle is arranged over at least a part region of a lateral surface 147 of the lower part 3, on which a means, more preferably elevations 149 and/or grooves 150 for fixing an inserted stamp pad 130 is positioned. The means in this case are designed corresponding to the means, more preferably the elevations 133 and grooves 134 on the stamp pad 30, so that when sliding in the stamp pad 130 it is protected from falling out and simultaneously held in the exact position since a vertical and horizontal force on the angular surface 146 of the stamp pad 130 is exerted by the means, more preferably the elevations 134, 149 and grooves 133, 150. Because of this, it is also prevented that the stamp plate 5 in rest position can be displaced through non-positive contact on the stamp pad 130 in horizontal direction. By designing the angle for the angular surface 146, 148 in the shaft 12 and on the stamp pod 130 the action of force can be additionally influenced, that is that with a flatter angle morn force is exerted in horizontal direction, whereas a steeper angle the vertical force gains the upper hand. In principle it can be mentioned here that the angular design of the surface 146, 148 in the shat 12 as well as on the stamp pad 130 need not run over the entire lateral surface 137 and 147. It is sufficient if merely a port region is designed thus. In this case it is however necessary that the starting region of the lateral surface 137 and 147 is always designed in an angular manner so that the stamp pad 130 can be pushed in and does not strike the angular surface 137 and 147 with the remaining part regions configured at a right angle.

However in order for the stamp pad 130 to be useable with the laterally arranged handle elements 138 the clearances 139 for inserting the handle element 138 of the stamp pad 130 and for the lateral gripping and pulling out of the stamp pad 130 are arranged in the shaft 12 of the lower part 3 or on the lower part 3 proper on two lateral surfaces 147. As is shown, the clearances 139 are arranged in the side wall or lateral surface 147 of the lower part 3. The depth or length and width of the clearance 139 correspond to the size of the handle elements 138, so that these can be securely inserted in the clearance 139.

It is substantial here that the upper part 2 is designed corresponding to the clearance 139 in the lower part 3, i.e. that the upper part 2 at least in a part region comprises an opening or clearance 152 on the side walls 151, so that in the removable position (FIGS. 31 and 32) for replacing the stamp pad 130 this opening or clearance 152 exposes the lateral access to the handle elements 138 in the clearance 139 of the lateral surfaces 147 of the lower part 3. Preferably the upper part 2 comprises a window 72 which extends from a front or rear wall 153 to the side wall 151 where it thus forms the clearance 152 for access to the handle elements 138. It is thus possible through suitable adjustment of the upper part 2, as is evident in FIGS. 31 and 32, to obtain free access to the handle elements 138. If the stamp 1 is in rest position according to FIGS. 29 and 30 the window 72 is displaced relative to the shaft 12 in the direction opposite to the contact surface of the stamp 1, as a result of which pulling out of the stamp pad 130 is not possible, since the lower part of the upper part 2 or the window 72 partially covers the stamp pad 130. If the stamp 1 is brought into the stamp position according to FIGS. 33 and 34 the window 72 is positioned below the stamp pad 130, as a result of which in turn removal of the stamp pod 130 is prevented.

Figure 32:
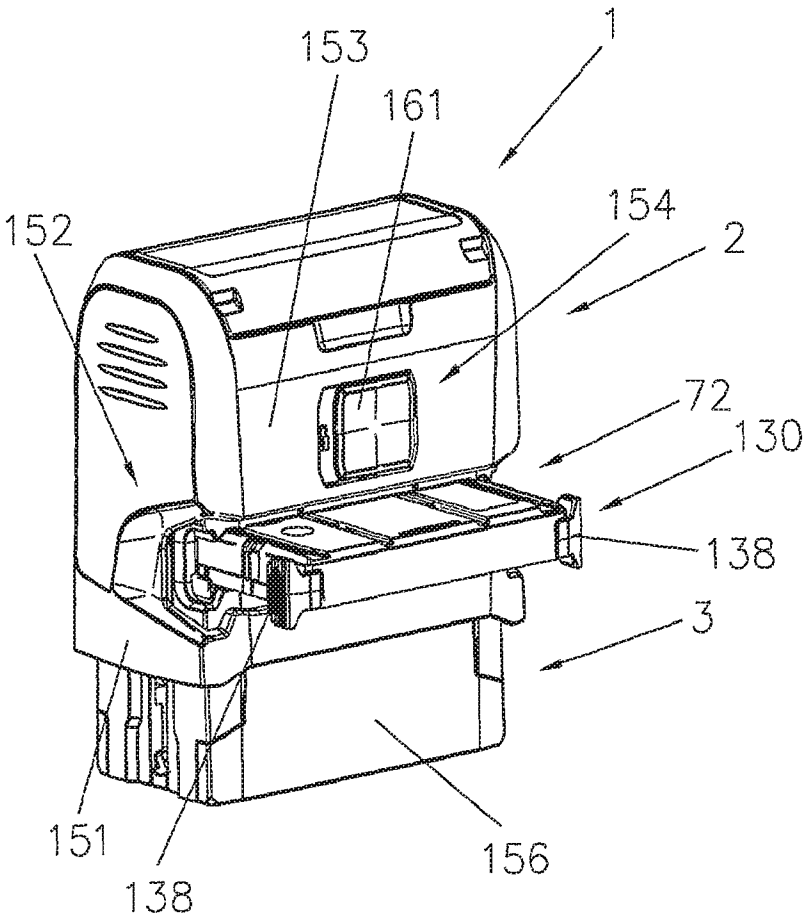
FIG. 32 shows a further perspective representation of the stamp according to FIG. 29 to 31 in the stamp pad changing position with partly pulled-out stamp pad.
Figure 31:
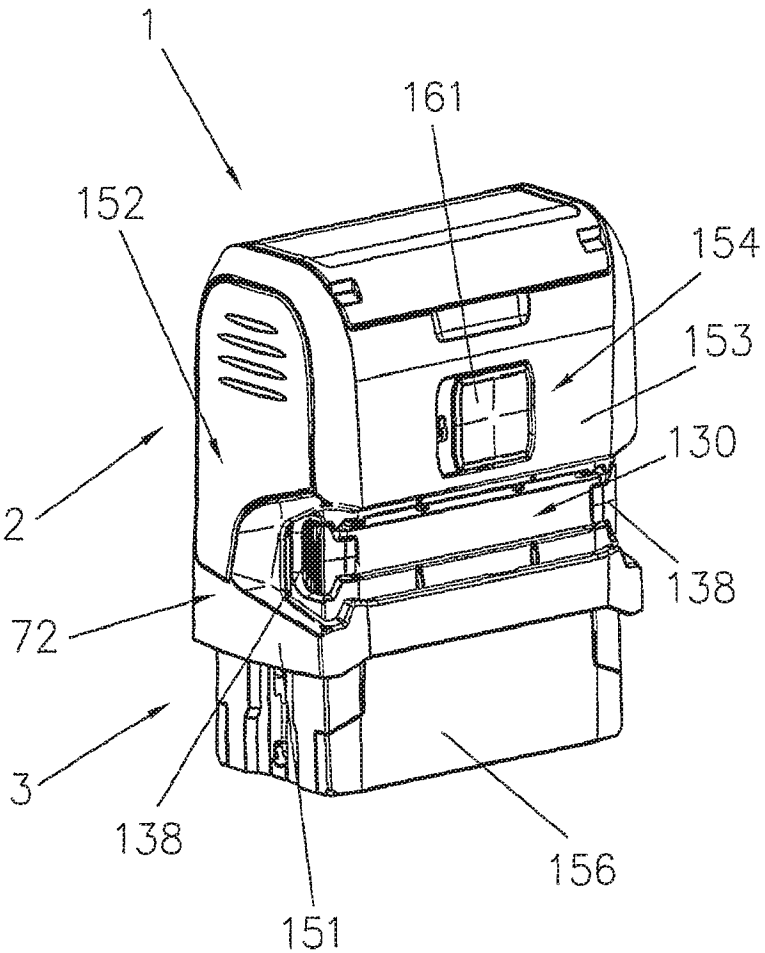
FIG. 31 shows a perspective representation of the stamp according to FIG. 29, 30 in stamp pad changing position.
Figure 34:
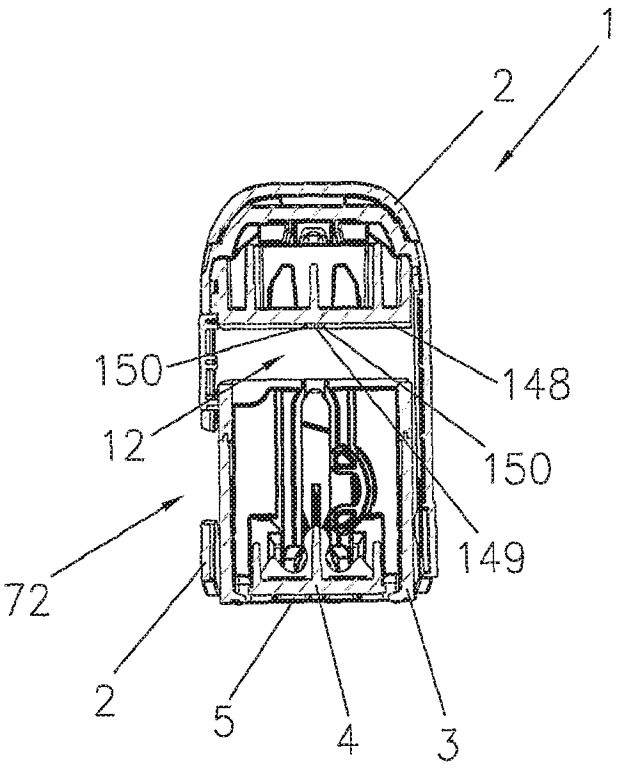
FIG. 34 shows a simplified sectional representation of the stamp according to FIG. 33 without stamp pad inserted.
Figure 33:
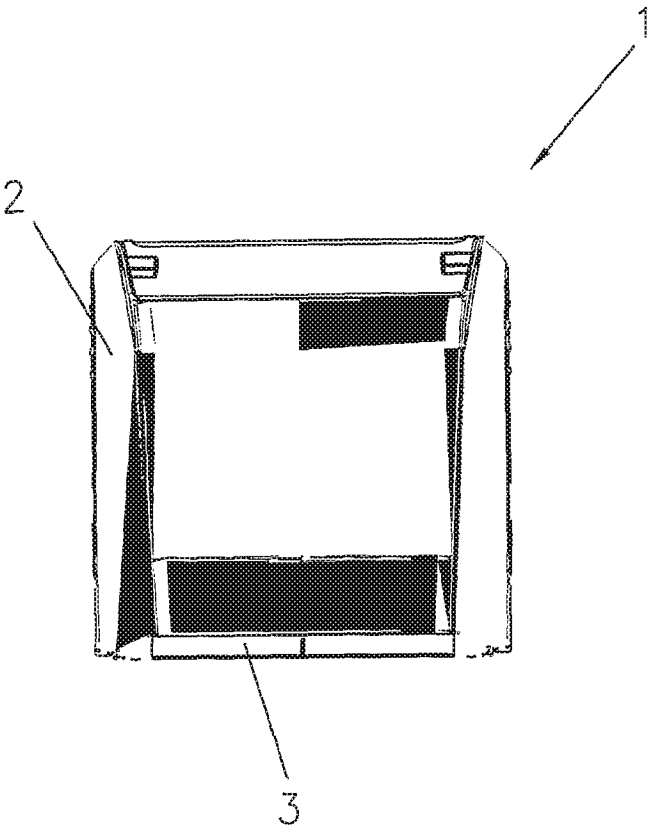
FIG. 33 shows a representation of the stamp in the stamping position.

With the new type of stamp 1 according to the invention with corresponding stamp pad 130 a stamp pod replacement is carried out in such a manner that in the rest position (FIGS. 29 and 30) the window 72 in the upper part 2, that is the lower edge of the window 72, at least partially covers the stamp pad 130 inserted in the shaft 12, so that the upper pert is displaced in the direction of the lower part 3 until the window 72 completely exposes the stamp pad 130, wherein the printing plate carrier 4 or the stamp plate 5 are simultaneously lifted off the stamp pad 130. In this stamp pad replacement position the upper part 2 can be fixed via a locking system 154 arranged on the front or rear wall 153, so that the user can release the stamp 1 and the two parts displaced into each other are held in that position. Following this it is possible via the window 72 to laterally reach the handle elements 138 and through these pull the stamp pad 130 out of the lower part 3 through the window 72 of the upper part 2 to the outside as indicated in FIG. 32. Since the handle elements 138 are arranged laterally, the user requires only two fingers for replacing the stamp pad 130, wherein through this arrangement of the handle elements 138 the user automatically exerts pressure on these and the stamp pad 130 is securely held between the two fingers. By doing so, direct contact with the storage material saturated with ink in the interior of the housing 131 is additionally prevented when removing the stamp pad 130. By releasing the locking system 154 the upper part 2 can slide back into its rest position and the stamp pad replacement operation is completed.

In addition, the lower part 3 can be designed in multiple parts, wherein different materials can be employed for the various parts 155, 156, more preferably hard plastic for the shape retention—part 155—soft plastic—part 156—for the support and positioning. Here, a part 156 is preferably designed transparently and is used in form of a window. This part 158 is used in the region of the contact surface so that for a stamping operation the user can look through the transparent part 156 and thus exactly position the stamp 1, since the user is able to look into the interior region of the stamp 1. To this and it is possible that positioning protrusions 157 are arranged in the region of the contact surface of the lower part 3.

Figure 35:
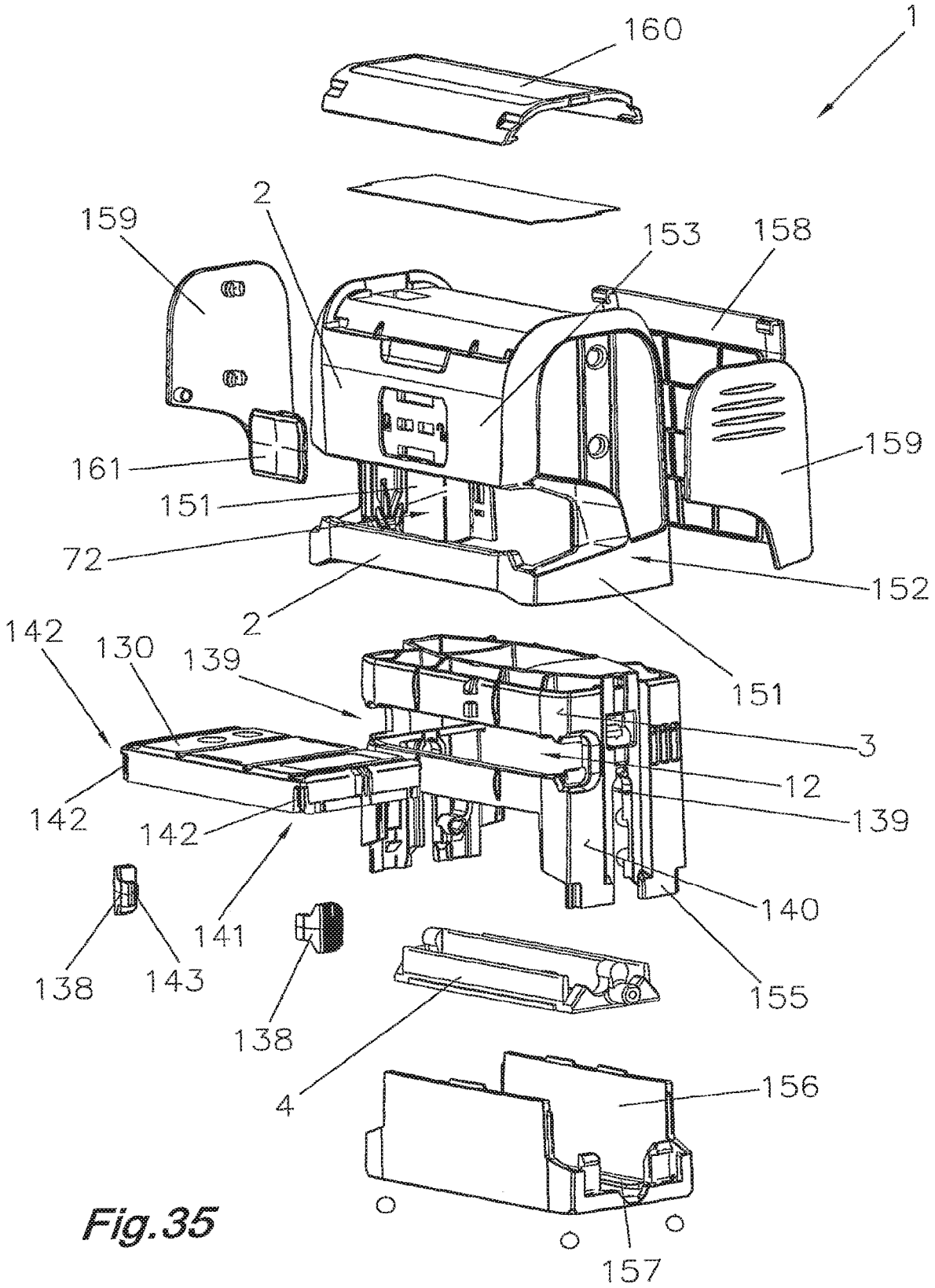
FIG. 35 shows an exploded representation of the stamp and the stamp pad according to FIG. 24 to 32.

To make possible a more simple assembly of the stamp 1 it is advantageous if the upper part 2 is likewise designed in multiple parts, as shown in FIG. 35. To this end, the upper part 2 comprises a removable decorative plate 158 so that the upper part 2 is open on one side and can thus be puled apart more easily, as a result of which easier placement on the lower part 3 is achieved. On the decorative plate 158 fastening means are arranged so that said decorative plate can be simply pressed on to the upper part 2 thus closing it. At the same time it is achieved that the upper part 2 no longer needs to be puled apart and is thus securely held on the lower part 3.

In order to make a visual adjustment of the appearance or the colour scheme different decorative plates 158 can be used. In addition, a decorative plate 159 can likewise be used on the side walls 151 which are simply pressed on to the side wall 151 via fastening means, more preferably a snap-on connection. A further decorative plate 160 can be fastened on the upper part 2, wherein this decorative plate 160 is designed transparently. Thus the user can insert a stamp imprint under the decorative plate 160 so that the user can identify which stamp 1 and stamp imprint he has in hand.

Figure 36:
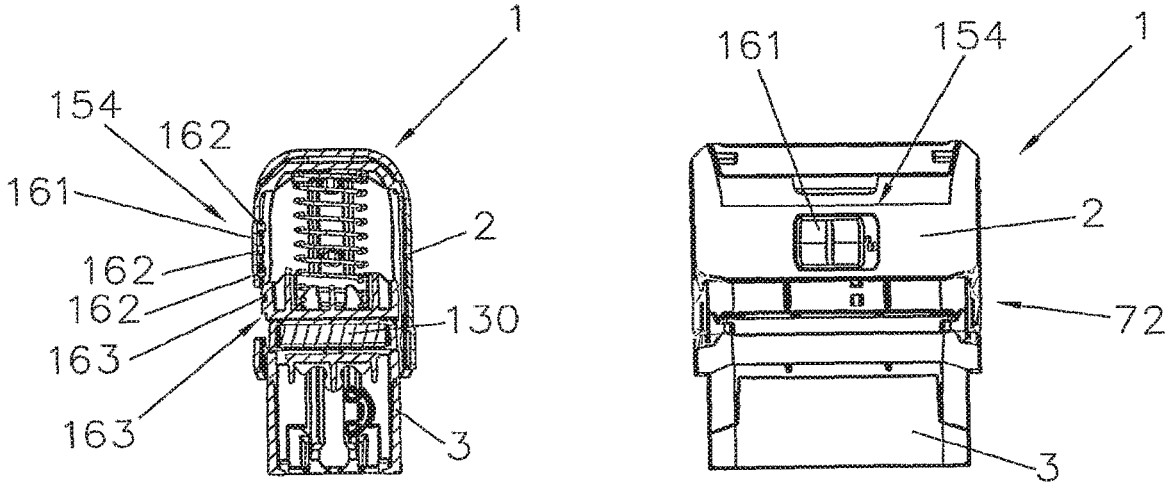
FIG. 36 shows a sectional representation with a corresponding front view of the stamp with a locking system in the rest position.
Figure 37:
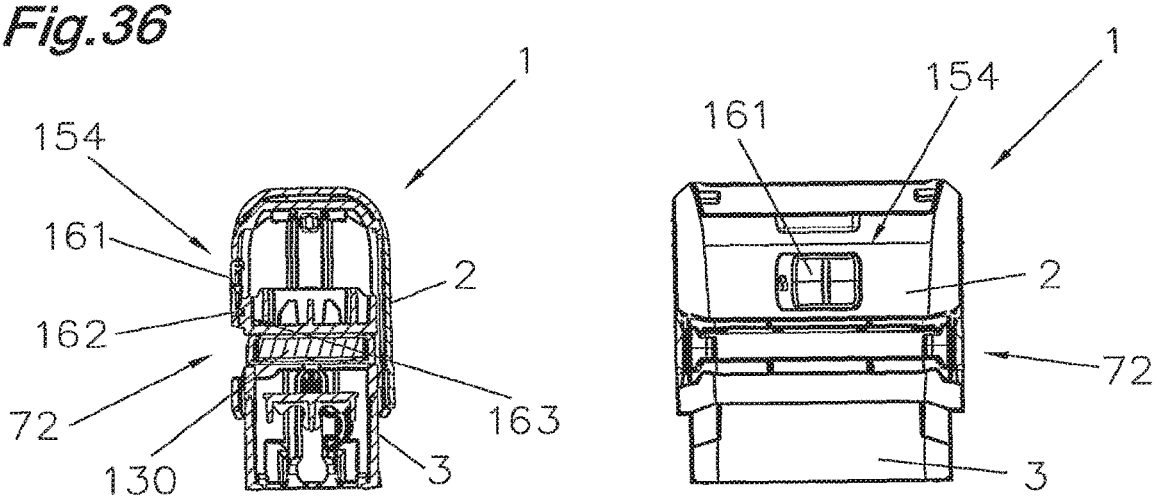
FIG. 37 shows a further sectional representation with a further associated front view of the stamp with a locking system in the first fixing position.
Figure 38:
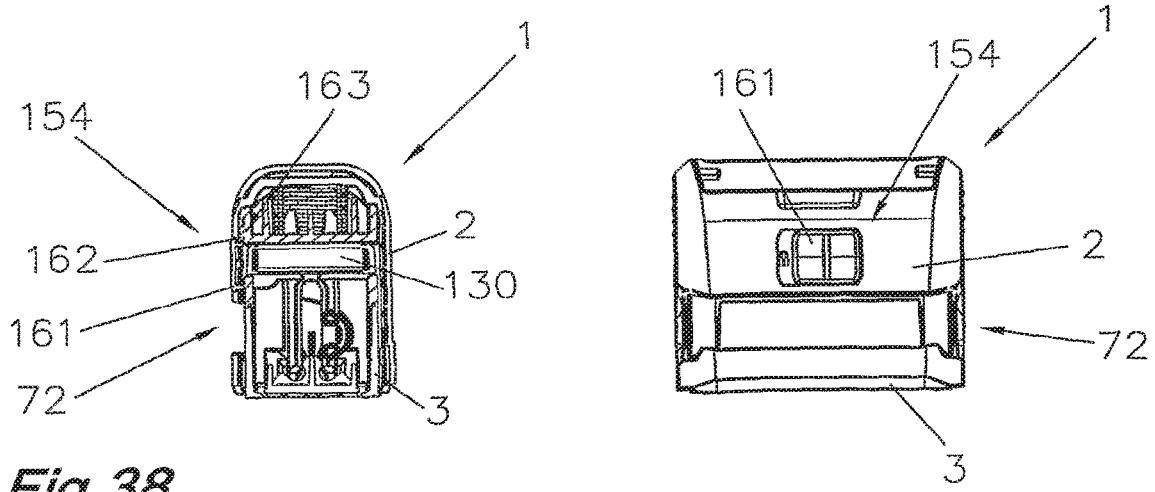
FIG. 38 shows a further sectional representation with a further associated front view of the stamp with a locking system in the second fixing position.

FIG. 36 to 38 shows the locking system 154 in detail. The locking system 154 is necessary for fixing the upper part 2 and the lower part 3 relative to each other, wherein this is now used for a plurality, more preferably two positions. To this end, an actuatable sliding lever 161 is arranged on the outside of the upper part 2. The sliding lever 161 can be moved into a left and right position in the exemplary embodiment shown, wherein in a position, more preferably in the left position, the parts of the stamp 1, more preferably the upper part 2 and the lower part 3, can be freely moved, whereas in the additional position in a certain position the upper part 2 and the lower part 3 are locked with respect to each other. For this to be possible the user has to suitably position the two parts relative to each other however, so that the sliding lever 161 can be shifted into the locking position, more preferably right position.

In order to make possible engagement of the upper part 2 with the lower part 3 a locking system is coupled with the sliding lever 161, which is formed in a simple form through protrusions 162 and notches 163. With the exemplary embodiment shown the sliding lever 101 is provided with a plurality of protrusions 162 which via slots which are not shown protrude into the interior of the upper part 2. Two notches 163 are provided on the lower part 3 in which with corresponding position of the sliding lever 181 the protrusions 162 engage thus interlocking the two parts.

In FIG. 36 the stamp 1 is shown with the locking system 161 in rest position. Here, the protrusions 162 and notches 163 are not engaged, so that a stamping operation can be carried out with the stamp 1. If the user for example now wishes to replace the stamp pad 130, he pushes the two parts, more preferably the upper part 2 and the lower part 3 into each other and simultaneously pushes the sliding lever into the locking position, more preferably in the right position, so that on reaching the correct position the protrusions 162 engage in the first notch 163 and the sliding lever 161 can be aid fully to the outside that is to the right, as shown in FIG. 37. Thus the window 72 is now directly situated in front of the shaft 12 and the user can pull out the stamp pad 130 through the window 72 by laterally gripping the handle elements 138 without any problems. In order to make it possible that the stamp 1 can be again displaced in the rest position or in the stamping position it is required that the sliding lever 161 is again slid into the other position, more preferably into the left position so that the two parts can be displaced again freely relative to each other. In order to now fix the stamp 1 in a transport position or stamping position, the user presses the upper part 2 as far as into the stamping position, that is all the way down and slides the sliding lever 161 to the right so that the protrusions 162 in turn engage in a corresponding notch 163 as shown in FIG. 38.

To facilitate recognising the positions it is possible that the individual positions are marked on the stamp 1. To this end, markings can be simply applied or stamped in. This is particularly advantageous if a plurality of positions for fixing are possible, so that the user can more quickly find the appropriate position. To this end it is possible for example that a suitable view window is provided on the upper part 2 so that the user can see the markings on the lower part 3.

It is substantial here that a stamp 1 with a hinged printing plate carrier 4 with a stamp plate 5 and with a receiving device for a replaceable carrying device 11 of a stamp pad 130 is used, wherein the printing plate carrier 4 and the receiving device are arranged in a lower part 3, and wherein the printing plate carrier 4 is adjustable in vertical direction from a starting position in which it contacts the stamp pad 130 with a pressing-on pressure into a position for generating a stamp imprint, and wherein the receiving device is formed by a shaft 12 running transversely to the vertical direction, wherein a locking system 161 is arranged for fixing the upper part 2 and the lower part 3 relative to each other, by means of which at least two positions can be fixed or locked. With such a solution it is achieved in an advantageous manner that in the locking situation the force application point of the lock in the position of the stamp pad change and in the transport or stamping position is always on the spring bottom on the housing 131, that is that the force of the spring acting on the housing bottom thus bringing about bending through of the latter, through which the locking knobbles, more preferably the protrusions 162, are counteracted in this region and bonding-through is thus minimized.

Figure 39:
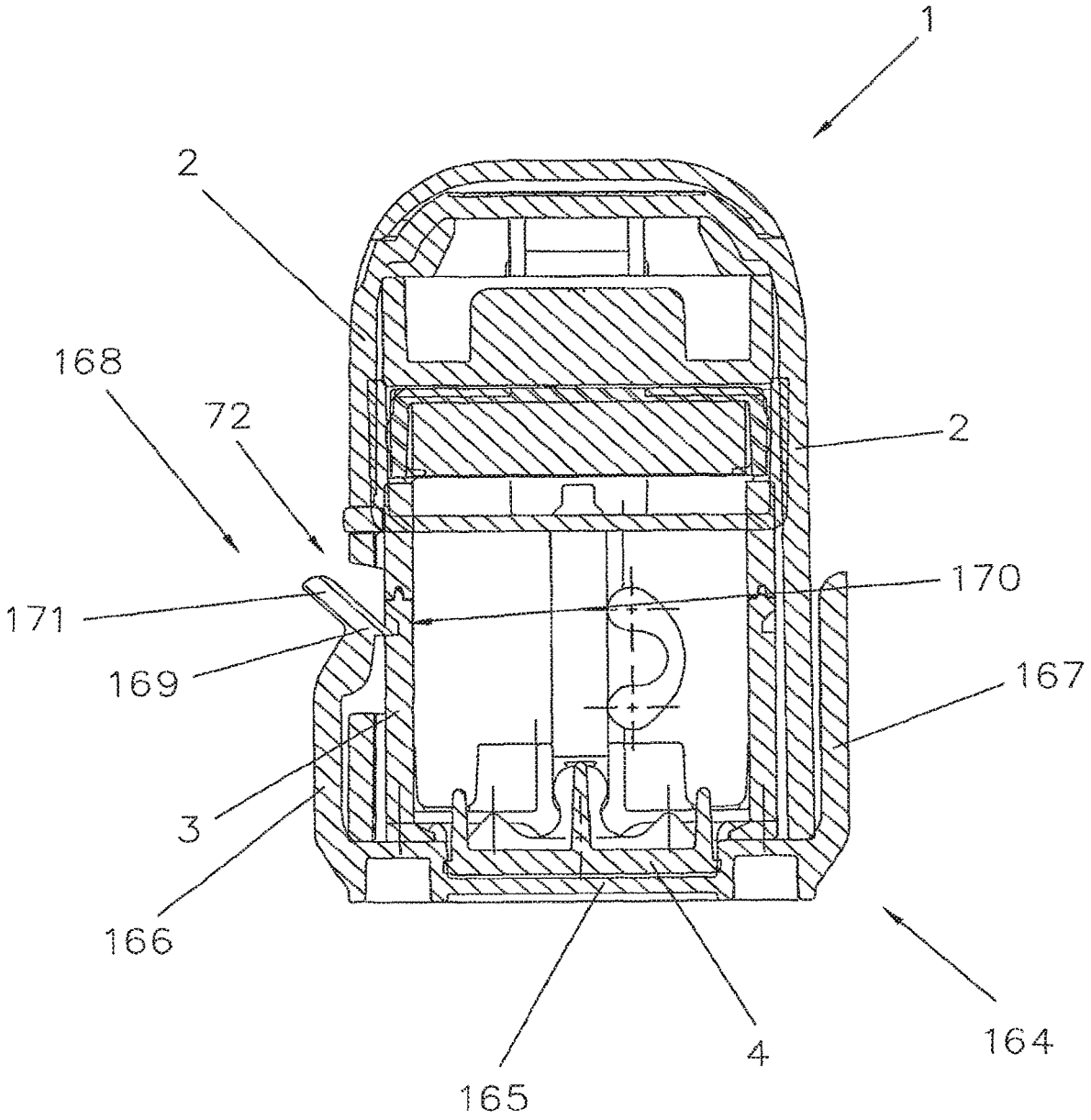
FIG. 39 shows a schematic representation of a stamp with a transport clamp in transport position.

Furthermore, a transport clamp 104 for a self-inking stamp 1 is shown in FIG. 39. The transport clamp 164 has the duty to fix the stamp 1, more preferably the upper part 2 and the lower part 3 relative to each other, wherein to this end the smallest possible size is to be created, i.e. that the stamp 1 in the stamping position, in which the upper part 2 has been completely slid over the lower part 3, is held via the transport clamp 164 and the stamp plate 5 thus covered by said transport clamp, so that during transport no contamination of the items in contact occurs and the smallest size for easy transport has been established at the same time.

To this end, the transport clamp 164 has now been designed in such a manner that, other than known from the prior art the clamp is not brought in connection with the upper part but the latter engages in the lower part 3. Here, the transport clamp 164 is formed from a base plate 165 from which on the longitudinal sides protrudes a tongue 166, 167 each in the same direction, wherein a tongue 106 is provided with a locking element 108.

The locking element 168 for example is designed in such a manner that in the end region it is slightly bent in the direction of the additional tongue 167 and at the end an engagement lug 169 extending in the direction of the additional tongue 167 for engagement in an engagement depression 170 arranged in the lower part 3 is arranged. In order to be able to release the tongue 167 more easily from the engagement, an engagement lever 171 is additionally provided which on suitable actuation in opposite direction to the engagement lug 169, releases the latter from the engagement impression 170.

It is substantial here that the engagement depression 170 is positioned on the lower part 3 in such a manner that with the stamp 1 pushed together, that is in the stamping position, the engagement depression 170 is positioned within the window 72 so that the tongue 186 with the engagement lug 169 can reach through the window 72 on to the lower part 2 and the engagement lug 160 can thus snap into the engagement depression 170. If alter the snapping-in of the engagement lug 169 in the engagement depression 170 the pressure on the stamp 1 is reduced or removed, the upper part 2 because of the spring arranged therein is moved in the direction of the starting position until t comes to a stop on the tongue 169. The difference to the prior art now is that the holding force for the transport clamp 161 is now no longer exerted on the upper part 2, but on the lower part 3, so that the upper part 2 is freely moveable without the engagement connection of the transport clamp 161 being released.

It can thus be said that the transport clamp 161 is designed for a stamp 1 with a hinged printing plate carrier 4 with a stamp plate 5 and with a receiving device for a replaceable carrying device 11 of a stamp pad 130, wherein the printing plate carrier 4 and the receiving device are arranged in a lower part 3, and wherein the printing plate carrier 4 is adjustable in vertical direction from a starting position in which it contacts the stamp pad 130 with a pressing-on pressure into a position for generating a stamp impression, and wherein the receiving device is at least formed through a shaft 12 running transversely to the vertical direction, wherein on a base plate 165 at least one tongue 166 with a blocking element 168 arranged thereon is arranged, wherein the blocking element 168 establishes an engagement connection with the lower part 3 through a window 72 of the upper part 2.

The advantage of such a solution is that no externally visible protrusions, elevations, depressions etc. for the engagement of the transport clamp 161 are now necessary and thus a visually attractive stamp can be created.

In principle it is pointed out that in the individual exemplary embodiments of FIG. 1 to 39 described before these can be combined into a single stamp 1 or a single stamp pad 130, i.e. that the individual elements or parts are adapted in accordance with the necessary technical solutions as described in FIG. 1 to 39, so that any combination and use of the individual solutions are possible.

As a matter of form it is pointed out in concluding that to better understand the construction of the stamp 1 the stamp or its components were partially shown not to scale and/or enlarged and/or reduced.

The object forming the basis of the independent inventive solutions can be taken from the description.

Above all, the individual embodiments shown in FIG. 1 to 7, FIG. 8 to 10, FIG. 11 to 14, FIG. 15 to 17, FIG. 18 to 21, FIG. 22 and FIG. 23, FIG. 24 to 28, FIG. 29 to 35, FIG. 36 to 38 and FIG. 39 can form the subject of the independent solutions according to the invention. The objects and solutions according to the invention in this regard can be taken from the detail descriptions of these Figures.

LIST OF REFERENCE NUMBERS

1 Stamp
2 Upper part
3 Lower part
4 Printing plate carrier
5 Stamp plate
6 Axle pin
7 Vertical guide
8 Side wall
9 Reversing mechanism
10 Stamp pad
11 Carrying device
12 Shaft
13 Drawer
14 Base plate
15 Front side
16 Handle
17 Opening
18 Clearance
19 Pushing-out direction
20 Pushing-in direction
21 Height
22 Ramp
23 Ramp
24 Guide profile
25 Driver strap
26 Elongated hole
27 Driver pin
28 Bevel
29 Length
30 Bearing element
31 Spring
32 Inner side
33 Housing wall
34 Side wall
35 Ramp
36 Driver lug
37 Bottom
38 Clearance
39 Length
40 Stop
41 Pad lifter
42 Adjusting travel
43 Pusher
44 Link path
45 Handle
46 Base plate
47 Guide profile
48 Driver pin
49 Front wall
50 Rear wall
51 Middle web
52 Guideway
53 Leg spring
54 Support pin
55 Side wall
56 Basic frame
57 Web
58 Sliding body
59 Guide groove
60 Engagement depression
61 Spring clip
62 Engagement
63 Path section
64 Path section
65 Path section
66 Driver lug
67 Depth
68 Height
69 Front wall
70 Edge
71 Edge
72 Window
73 Depth
74 Height
75 Lock, bolt
76 Stop
77 Clamp
78 Handle
79 Distance
80 Tooth profile
81 Tooth profile
82 Handle
83 Swivel axis
84 Cover
85 Predetermined breakage point
86 Guide profile
87 Guide profile
88 Fitting direction
89 Pulling-off direction
90
91
92
93
94
95
96
97
98
99
100
101 Chamfer

102 Receptacle
103 Inner chamfer
104 Chamfer width
105 Height
106
107
108
109
110 Guide profile
111 Ramp
112 First ramp section
113 Second ramp section
114 Guide profile
115 Ramp
116
117
118
119
120 Guide profile
121 Displacement direction
122 Path section
123 Displacement distance
124 Spacing
125 Engagement position
126
127
128
129
130 Stamp pad
131 Housing
132 Pad
133 Groove
134 Elevation
135 Base plate
136 Longitudinal surface
137 Lateral surface
138 Handle element
139 Recess
140 Outer surface
141 Fastening means
142 Groove
143 Protrusion
144 Width
145 Width
146 Surface
147 Lateral surface
148 Surface
149 Elevation
150 Groove
151 Side wall
152 Clearance
153 Rear well
154 Locking system
155 Part
156 Part
157 Positioning protrusion
158 Decorative plate
159 Decorative plate
160 Decorative plate
161 Sliding lever
162 Protrusion
163 Notch
164 Transport clamp
165 Base plate
166 Tongue
167 Tongue
168 Locking element
169 Engagement lug
170 Engagement depression
171 Engagement lever

The invention claimed is:

1. A stamp comprising:

a pivotable printing plate carrier with a stamp plate;

a receiving device for a stamp pad assembly including a replaceable carrying device and a stamp pad, the carrying device including handles;

wherein the printing plate carrier and a receptacle are arranged in a lower part of the stamp in a prismatic shape, wherein the printing plate carrier is adjustable by way of contact pressure in a vertical direction from a starting position in which it contacts the stamp pad, into a position for producing a stamp impression wherein the printing plate carrier is movement-coupled with an upper part and telescopically guided on the lower part, wherein the receiving device is formed by at least one shaft traversing the vertical direction, the receptacle having an approximately rectangular cross section and an opening in a front wall of the lower part, wherein the upper part encloses the lower part, wherein in the starting position of the upper part comprises a lower edge extending below the opening of the lower part, and the upper part includes a window corresponding with the opening, wherein in the starting position the window is located in a position above the opening in the front wall so that the opening of the lower part is at least partially covered, and wherein the window extends across the entire width of the front wall of the upper part and extends into lateral walls of the upper part across a depth, thereby forming a recess for access to the handles of the carrying device.

2. The stamp according to claim 1, wherein the upper part comprises a lock and the lower part comprises a stop, wherein the lock and the stop are structured and arranged to be brought into engagement for fixing the window in a position aligned relative to the opening.

3. The stamp according to claim 1, wherein the handles extend at least partially in the direction which corresponds to a depth of the opening in the lower part in which the stamp pad assembly may be inserted or removed.

4. The stamp according to claim 3, wherein of the handles include a pair of handles, wherein sides of the two handles facing each other are connected on narrow sides of the carrying device through engagement connections with the carrying device.

5. The stamp according to claim 4, wherein tooth profiles are arranged on the two handles and complementary tooth profiles are on the carrying device.

6. The stamp according to claim 1, wherein the handles are molded onto the lateral surfaces of the carrying device.

7. The stamp according to claim 1, wherein the carrying device comprises opposing long narrow sides extending traverse to the lateral surfaces, the two handles include portions that extend partially parallel to the direction of the adjacent long narrow sides, the carrying device comprises a guide profile, and the handles comprise an extension arranged within the guide profile of the carrying device.

8. The stamp according to claim 1, wherein the carrying device comprises opposing short narrow sides and a chamfered edge extending along at least a portion of the short narrow sides.

9. The stamp according to claim 8, wherein the chamfered edge has an engagement position.

* * * * *